US008521060B2

(12) United States Patent
Numata et al.

(10) Patent No.: US 8,521,060 B2
(45) Date of Patent: Aug. 27, 2013

(54) CARTRIDGE WITH A PROTECTING MEMBER AND A SEALING MEMBER FOR SEALING A DEVELOPER SUPPLY OPENING

(75) Inventors: Tetsuya Numata, Suntou-gun (JP); Shigeo Miyabe, Numazu (JP); Takahito Ueno, Mishima (JP); Shinjiro Toba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 13/030,680

(22) Filed: Feb. 18, 2011

(65) Prior Publication Data

US 2011/0142491 A1 Jun. 16, 2011

Related U.S. Application Data

(63) Continuation of application No. PCT/JP2009/065561, filed on Sep. 1, 2009.

(30) Foreign Application Priority Data

Sep. 1, 2008 (JP) ..... 2008-223045
Sep. 1, 2008 (JP) ..... 2008-223403

(51) Int. Cl.
*G03G 15/08* (2006.01)

(52) U.S. Cl.
USPC ..... 399/111; 399/262

(58) Field of Classification Search
USPC ..... 399/111, 119, 262, 102, 103
See application file for complete search history.

(56) References Cited

U.S. PATENT DOCUMENTS 5,331,373 A 7/1994 Nomura et al.
5,452,056 A 9/1995 Nomura et al.
5,463,446 A 10/1995 Watanabe et al.
5,585,889 A 12/1996 Shishido et al.
5,640,650 A 6/1997 Watanabe et al.
5,839,028 A 11/1998 Nomura et al.
5,873,012 A 2/1999 Miyabe et al.
5,878,309 A 3/1999 Nomura et al.

(Continued)

FOREIGN PATENT DOCUMENTS

JP 06035247 A * 2/1994
JP 9-81012 3/1997

(Continued)

OTHER PUBLICATIONS

Machine translation of JP-2003-173076.*

(Continued)

*Primary Examiner* — G. M. Hyder
(74) *Attorney, Agent, or Firm* — Fitzpatrick, Cella, Harper & Scinto

(57) ABSTRACT

A developing cartridge detachably mountable to image forming apparatus includes a developer carrying member for developing an electrostatic latent image formed on the image bearing member; a protecting member, demountable in the axial direction of said developer carrying member from said frame; an accommodating portion accommodating the developer to be supplied to said developer carrying member; a sealing member sealing an opening for permitting the developer to be supplied from said accommodating portion to said developer carrying member; and a grip portion, provided at one longitudinal end of said sealing member, for being gripped when said sealing member is removed from said opening, said grip portion being movable between a first position on a movement locus of said protecting member when said protecting member is dismounted from said frame, and a second position outside the movement locus.

10 Claims, 34 Drawing Sheets

(56) References Cited

U.S. PATENT DOCUMENTS

| | | | | |
|---|---|---|---|---|
| 5,878,310 | A | 3/1999 | Noda et al. | |
| 5,926,666 | A | 7/1999 | Miura et al. | |
| 5,937,237 | A | 8/1999 | Nonaka et al. | |
| 5,943,529 | A | 8/1999 | Miyabe et al. | |
| 5,946,531 | A | 8/1999 | Miura et al. | |
| 5,950,047 | A | 9/1999 | Miyabe et al. | |
| 5,966,567 | A | 10/1999 | Matsuzaki et al. | |
| 6,029,031 | A | 2/2000 | Yokomori et al. | |
| 6,032,002 | A | 2/2000 | Yokomori et al. | |
| 6,047,150 | A * | 4/2000 | Kanno et al. | 399/119 |
| 6,064,843 | A | 5/2000 | Isobe et al. | |
| 6,072,968 | A | 6/2000 | Nomura et al. | |
| 6,128,452 | A | 10/2000 | Miyabe et al. | |
| 6,137,975 | A | 10/2000 | Harumoto et al. | |
| 6,154,623 | A | 11/2000 | Suzuki et al. | |
| 6,167,219 | A | 12/2000 | Miyamoto et al. | |
| 6,173,140 | B1 | 1/2001 | Suzuki et al. | |
| 6,181,898 | B1 * | 1/2001 | Sato | 399/103 |
| 6,215,969 | B1 | 4/2001 | Nomura et al. | |
| 6,282,390 | B1 | 8/2001 | Miyabe et al. | |
| 6,317,572 | B1 | 11/2001 | Miyabe et al. | |
| 6,336,017 | B1 | 1/2002 | Miyamoto et al. | |
| 6,351,620 | B1 | 2/2002 | Miyabe et al. | |
| 6,385,416 | B1 | 5/2002 | Horikawa et al. | |
| 6,415,121 | B1 | 7/2002 | Suzuki et al. | |
| 6,424,811 | B1 | 7/2002 | Tsuda et al. | |
| 6,519,431 | B1 | 2/2003 | Toba et al. | |
| 6,542,706 | B2 | 4/2003 | Toba et al. | |
| 6,549,736 | B2 | 4/2003 | Miyabe et al. | |
| 6,603,939 | B1 | 8/2003 | Toba et al. | |
| 6,608,980 | B2 | 8/2003 | Murayama et al. | |
| 6,678,488 | B2 | 1/2004 | Toba et al. | |
| 6,714,752 | B2 | 3/2004 | Ueno et al. | |
| 6,795,666 | B2 | 9/2004 | Miyabe et al. | |
| 6,823,153 | B2 | 11/2004 | Ueno et al. | |
| 6,829,455 | B2 | 12/2004 | Yasumoto et al. | |
| 6,834,175 | B2 | 12/2004 | Murayama et al. | |
| 6,836,629 | B2 | 12/2004 | Miyabe et al. | |
| 6,898,391 | B2 | 5/2005 | Numagami et al. | |
| 6,912,365 | B2 | 6/2005 | Ueno et al. | |
| 6,931,226 | B2 | 8/2005 | Chadani et al. | |
| 6,934,485 | B2 | 8/2005 | Miyabe et al. | |
| 6,937,834 | B2 | 8/2005 | Kanno et al. | |
| 6,954,600 | B2 | 10/2005 | Fujita et al. | |
| 6,954,601 | B2 | 10/2005 | Numagami et al. | |
| 6,968,146 | B1 | 11/2005 | Fujita et al. | |
| 6,970,668 | B2 | 11/2005 | Ueno et al. | |
| 6,978,099 | B2 | 12/2005 | Ueno et al. | |
| 6,990,302 | B2 | 1/2006 | Toba et al. | |
| 7,003,247 | B2 | 2/2006 | Koishi et al. | |
| 7,062,200 | B2 | 6/2006 | Ueno et al. | |
| 7,092,658 | B2 | 8/2006 | Yasumoto et al. | |
| 7,136,604 | B2 | 11/2006 | Chadani et al. | |
| 7,139,502 | B2 | 11/2006 | Koishi et al. | |
| 7,149,457 | B2 | 12/2006 | Miyabe et al. | |
| 7,155,141 | B2 | 12/2006 | Sato et al. | |
| 7,158,736 | B2 | 1/2007 | Sato et al. | |
| 7,158,749 | B2 | 1/2007 | Ueno et al. | |
| 7,164,875 | B2 | 1/2007 | Miyabe et al. | |
| 7,174,122 | B2 | 2/2007 | Fujita et al. | |
| 7,184,690 | B2 | 2/2007 | Ueno et al. | |
| 7,206,534 | B2 * | 4/2007 | Murakami | 399/103 |
| 7,209,682 | B2 | 4/2007 | Numagami et al. | |
| 7,212,768 | B2 | 5/2007 | Numagami et al. | |
| 7,218,882 | B2 | 5/2007 | Toba et al. | |
| 7,224,925 | B2 | 5/2007 | Sato et al. | |
| 7,248,810 | B2 | 7/2007 | Miyabe et al. | |
| 7,315,710 | B2 | 1/2008 | Ueno et al. | |
| 7,349,657 | B2 | 3/2008 | Sato et al. | |
| 7,366,452 | B2 | 4/2008 | Fujita et al. | |
| 7,412,193 | B2 | 8/2008 | Sato et al. | |
| 7,440,715 | B2 | 10/2008 | Numagami et al. | |
| 7,450,877 | B2 | 11/2008 | Miyabe et al. | |
| 7,457,566 | B2 | 11/2008 | Koishi et al. | |
| 7,483,646 | B2 | 1/2009 | Ueno et al. | |
| 7,499,663 | B2 | 3/2009 | Sato et al. | |
| 7,630,665 | B2 | 12/2009 | Ueno et al. | |
| 7,689,146 | B2 | 3/2010 | Sato et al. | |
| 7,702,251 | B2 | 4/2010 | Miyabe et al. | |
| 7,711,287 | B2 | 5/2010 | Kimizuka et al. | |
| 7,715,746 | B2 | 5/2010 | Tanabe et al. | |
| 7,720,408 | B2 | 5/2010 | Ueno et al. | |
| 7,813,668 | B2 | 10/2010 | Ueno et al. | |
| 7,860,433 | B2 | 12/2010 | Toba et al. | |
| 7,894,733 | B2 | 2/2011 | Tanabe et al. | |
| 7,945,185 | B2 | 5/2011 | Miyabe et al. | |
| 2008/0152388 | A1 | 6/2008 | Ueno et al. | |
| 2008/0240796 | A1 | 10/2008 | Morioka et al. | |
| 2008/0260428 | A1 | 10/2008 | Ueno et al. | |
| 2008/0286000 | A1 | 11/2008 | Kimizuka et al. | |
| 2009/0317134 | A1 | 12/2009 | Miyabe et al. | |
| 2009/0317135 | A1 | 12/2009 | Miyabe et al. | |
| 2010/0054796 | A1 | 3/2010 | Nakamura et al. | |
| 2010/0054804 | A1 | 3/2010 | Uneme et al. | |
| 2010/0054805 | A1 | 3/2010 | Numata et al. | |
| 2010/0054806 | A1 | 3/2010 | Ueno et al. | |
| 2010/0054807 | A1 | 3/2010 | Takeyama et al. | |
| 2010/0054823 | A1 | 3/2010 | Takasaka et al. | |
| 2010/0158563 | A1 | 6/2010 | Tanabe et al. | |
| 2011/0038649 | A1 | 2/2011 | Miyabe et al. | |
| 2011/0044717 | A1 | 2/2011 | Miyabe et al. | |
| 2011/0064459 | A1 | 3/2011 | Toba et al. | |
| 2011/0091239 | A1 | 4/2011 | Ueno et al. | |
| 2011/0103823 | A1 * | 5/2011 | Ueno et al. | 399/106 |
| 2011/0103825 | A1 | 5/2011 | Numata et al. | |
| 2011/0103826 | A1 | 5/2011 | Numata et al. | |
| 2011/0103827 | A1 | 5/2011 | Uneme et al. | |
| 2011/0103832 | A1 | 5/2011 | Hayashi et al. | |
| 2011/0206412 | A1 | 8/2011 | Tanabe et al. | |

FOREIGN PATENT DOCUMENTS

| | | |
|---|---|---|
| JP | 10-39603 | 2/1998 |
| JP | 11072984 | 3/1999 |
| JP | 2000-019839 | 1/2000 |
| JP | 2002-132011 | 5/2002 |
| JP | 2003-173076 | 6/2003 |
| JP | 2003-195730 | 7/2003 |
| JP | 2005-31391 | 2/2005 |
| JP | 2005-266637 | 9/2005 |

OTHER PUBLICATIONS

Office Action in Chinese Patent Application No. 200980133759.4, mailed Oct. 15, 2012 (with English translation).

* cited by examiner

CARTRIDGE WITH A PROTECTING MEMBER AND A SEALING MEMBER FOR SEALING A DEVELOPER SUPPLY OPENING

FIELD OF THE INVENTION

The present invention relates to a developing cartridge, a process cartridge and an electrophotographic image forming apparatus for forming an image using a developer.

Here, the electrophotographic image forming apparatus is an apparatus forming the image on a recording material using an electrophotographic image forming process. For example, it includes an electrophotographic copying machine, an electrophotographic printer (a LED, a printer, a laser beam printer or the like), an electrophotographic printer type facsimile machine, and an electrophotographic printer type word processor and so on.

A developing cartridge is a unit containing a developer carrying member such an electrophotographic photosensitive member for developing an electrostatic latent image formed on the image bearing member, which are unified into a cartridge which is detachably mountable to a main assembly of the electrophotographic image forming apparatus.

The process cartridge is a unit containing an image bearing member such as an electrophotographic photosensitive member, a developer carrying member for developing the electrostatic latent image formed on the image bearing member and a developer accommodating portion for accommodating a developer, which are unified into a cartridge detachably mountable to the main assembly of the electrophotographic image forming apparatus.

BACKGROUND ART

Conventionally, an image forming apparatus using the electrophotographic image forming process is provided with a developer sealing member between a developing member accommodating portion supporting a developing roller actable on an electrophotographic photosensitive drum and the developer accommodating portion accommodating the developer in order to prevent leakage of the developer during transportation.

And, after the transportation, the sealing member is removed, and the image forming operation can be carried out. Such a structure is used widely in the electrophotographic image forming apparatus.

Since the developer sealing member is drawn from the developing cartridge, an end of a drawing portion of the developer sealing member is provided with a grip portion, and a grip member is provided with a hole portion into which the user inserts the finger to remove the developer sealing member. This is known (Japanese Laid-open Patent Application Hei 10-39603, Patent No. 03679614 (FIG. 10)).

Recently, in order to improve an operationality in the initial installation of the main assembly of the electrophotographic image forming apparatus, it is ordinary that the electrophotographic image forming apparatus is transported while the developing cartridge is mounted in the main assembly of the apparatus (packed together). In such a case, each developing cartridge is provided with a covering member mounted thereto to protect the developer carrying member. In order to protect assuredly the developer carrying member, it is required that at the time of initial installation, the user accesses the developing cartridge and take it out of the main assembly of the apparatus, and then dismounts the covering member, and thereafter returns it into the main assembly of the apparatus. Japanese Laid-open Patent Application 2000-019839 discloses a structure accomplishing this.

Recently, downsizing of the electrophotographic image forming apparatus is desired. To meet the desire, the developing cartridge mounted to the apparatus is also required to be downsized. However, if the grip portion of the developer sealing member is also downsized when downsizing the developing cartridge, the grip portion becomes uneasy to handle, that is, the usability may be sacrificed.

In addition, in the conventional example, when the developing cartridge having the covering member is dismounted from the main assembly of the apparatus upon the initial installation of the main assembly of the apparatus, the developing cartridge is accessible at one side of the main assembly of the apparatus and is removed from one axial end of the developer carrying member. The covering member is demountable in the same direction as the removing direction of the developing cartridge.

DISCLOSURE OF INVENTION

Accordingly, it is a principal object of the present invention to provide a developing cartridge and a process cartridge wherein the grip portion is as large as possible not at the cost of the usability even when the cartridge is downsized.

It is another object of the present invention to provide a developing cartridge and a process cartridge wherein the covering member of the developing cartridge which is detachably mountable in the direction perpendicular to an axial direction of the developer carrying member is prevented from disengaging at the time of the initial installation of the main assembly of the image forming apparatus. It is a further object of the present invention to provide a developing cartridge and an image forming apparatus, wherein by this, an assured protection of the developer carrying member is accomplished.

It is a further object of the present invention to provide a developing cartridge having a grip portion in the direction perpendicular to the axial direction of the developer carrying member wherein the covering member is prevented from being removed unintentionally by the operation of gripping the grip portion. By this, an assured protection of the developer carrying member is accomplished.

The present invention provides a developing cartridge detachably mountable to an image forming apparatus, said developing cartridge comprising a developer carrying member for developing an electrostatic latent image formed on an image bearing member; a frame for supporting said developer carrying member; a protecting member for protecting said developer carrying member, said protecting member being dismountable from said frame in an axial direction of said developer carrying member; an accommodating portion accommodating a developer to be supplied to said developer carrying member; a sealing member sealing an opening for permitting the developer to be supplied from said accommodating portion to said developer carrying member; and a grip portion, provided at one longitudinal end of said sealing member, for being gripped when said sealing member is removed from said opening, said grip portion being movable between a first position on a movement locus of said protecting member when said protecting member is dismounted from said frame, and a second position outside the movement locus.

In addition, the present invention provides a process cartridge detachably mountable to an image forming apparatus, said process cartridge comprising an image bearing member on which an electrostatic latent image is to be formed; a frame supporting said image bearing member; a protecting member for protecting said image bearing member, said protecting member being dismountable from said frame in an axial direction of said image bearing member; a developer carrying member for developing an electrostatic latent image formed on said image bearing member; an accommodating portion accommodating a developer to be supplied to said developer carrying member; a sealing member sealing an opening for permitting the developer to be supplied from said accommodating portion to said developer carrying member; and a grip portion, provided at one longitudinal end of said sealing member, for being gripped when said sealing member is removed from said opening, said grip portion being movable between a first position on a movement locus of said protecting member when said protecting member is dismounted from said frame, and a second position outside the movement locus.

Furthermore, the present invention provides an image forming apparatus for forming an image on a recording material, said image forming apparatus comprising (i) a mounting portion; (ii) an image bearing member; (iii) a developing cartridge mounted to said mounting portion, said developing cartridge being dismountable from said mounting portion in a direction perpendicular to an axial direction of said developer carrying member, said developing cartridge including, a developer carrying member for developing an electrostatic latent image formed to said image bearing member, a frame for supporting said developer carrying member, a protecting member for protecting said developer carrying member, said protecting member being dismountable from said frame in an axial direction of said developer carrying member, an accommodating portion accommodating a developer to be supplied to said developer carrying member, a sealing member sealing an opening for permitting the developer to be supplied from said accommodating portion to said developer carrying member; and a grip portion, provided at one longitudinal end of said sealing member, for being gripped when said sealing member is removed from said opening; (iv) a regulating portion, contacted to said protecting member in a state that developing cartridge is mounted to said mounting portion, for regulating movement of said protecting member in the axial direction; and (v) feeding means for feeding the recording material.

The developing cartridge according to a preferred embodiment of the present invention will be described with an electrophotographic image forming apparatus (image forming apparatus) with which the developing cartridge is usable, referring to the drawings.

FIRST EMBODIMENT

First, the description will be made as to structures of an image forming apparatus which is loaded with a developing cartridge according to this embodiment to form an image, together with image forming operations thereof.

(General Arrangement of Color Image Forming Apparatus)

The image forming apparatus of this embodiment is a laser beam printer (four (full) color).

FIG. 2 is a sectional view illustrating a schematic structure during a developing operation of a yellow developing cartridge 5*a*.

FIG. 3 is a sectional view illustrating a schematic structure during a developing operation of a black developing cartridge 5*d*.

As shown in FIG. 2, the image forming apparatus 100 comprises a photosensitive drum 2*a* which is an image bearing member on which an electrostatic latent image is to be formed. Around the photosensitive drum 2*a*, there are provided charging means for charging uniformly the photosensitive drum 2*a* (charging roller 2*b* in this embodiment), exposure means 15 for forming a latent image by exposing the photosensitive drum 2*a* with a laser beam, the yellow developing cartridge 5*a*, a magenta developing cartridge 5*b*, a cyan developing cartridge 5*c* and the black developing cartridge 5*d* for visualizing a latent image formed on the photosensitive drum 2*a* by developing it with toner which is a developer of the corresponding color, and cleaning means 2*c* for removing residual toner on the photosensitive drum 2*a*. In this embodiment, the photosensitive drum 2*a*, the charging means 2*b* and the cleaning means 2*c* are integral, and are detachably mountable relative to the image forming apparatus 100 (drum cartridge 2). The photosensitive drum 2*a*, the charging means 2*b* and the cleaning means 2*c* may be independent from each other or unified together.

A rotary 1 supports the yellow developing cartridge 5*a*, the magenta developing cartridge 5*b*, the cyan developing cartridge 5*c* and the black developing cartridge 5*d* at regular intervals. The rotary 1 supports the yellow developing cartridge 5*a*, the magenta developing cartridge 5*b*, the cyan developing cartridge 5*c* and the black developing cartridge 5*d* with the structures.

Therefore, the description of the supporting structures will be made only with the yellow developing cartridge 5*a*, representing all of the yellow developing cartridge 5*a*, the magenta developing cartridge 5*b*, the cyan developing cartridge 5*c* and the black developing cartridge 5*d*.

The yellow developing cartridge 5*a* is mounted to the rotary 1, and a portion-to-be-locked 61*ca* provided on the yellow developing cartridge 5*a* is engaged with a developing cartridge locking member 19*a* provided on the rotary 1, thereby to prevent the yellow developing cartridge 5*a* from popping out of the rotary 1. The developing cartridge locking member 19*a* is urged by a spring (unshown) in a direction (arrow D) of engaging with the yellow developing cartridge 5*a*.

The magenta developing cartridge 5*b*, the cyan developing cartridge 5*c* and the black developing cartridge 5*d* are provided with portions-to-be-locked 61*cb*, 61 *cc*, and 61*cd*, respectively. The portions-to-be-locked is engaged with developing cartridge locking members 19*b*, 19*c*, 19*d* provided on the rotary 1 so that the developing cartridges are prevented from popping out of the rotary 1.

The rotary 1 is rotatable relative to a main assembly frame while supporting the yellow developing cartridge 5*a*, the magenta developing cartridge 5*b*, the cyan developing cartridge 5*c* and the black developing cartridge 5*d*. In this embodiment, the yellow developing cartridge 5*a*, the magenta developing cartridge 5*b*, the cyan developing cartridge 5*c* and the black developing cartridge 5*d* are detachably mountable relative to the rotary 1.

In the image formation, the photosensitive drum 2*a* is rotated in the direction of arrow A. Simultaneously, an intermediary transfer belt 3 is rotated in the direction of an arrow C in synchronism with the photosensitive drum 2*a*. A surface of the photosensitive drum 2*a* is charged uniformly by the charging means 2*b*, and is exposed to yellow image light by the exposure means 15, so that an electrostatic latent image for yellow color is formed on the photosensitive drum 2*a*.

Simultaneously with formation of the electrostatic latent image, the rotary 1 rotates about a rotation shaft 1*a* by a drive transmission mechanism provided in the image forming apparatus 100 while supporting the yellow, magenta, cyan and black developing cartridges 5*a*, 5*b*, 5*c*, 5*d*.

By doing so, the rotary 1 rotates bring the yellow developing cartridge 5*a* to a developing position where it is opposed to the photosensitive drum 2*a* (FIG. 2).

A potential difference is provided between the photosensitive drum 2*a* and the developing roller 51*a* so that a yellow developer is deposited on the latent image formed on the photosensitive drum 2*a*. By doing so, the yellow developer is deposited on the latent image formed on the photosensitive drum 2*a*. In other words, a yellow developed image is formed on the photosensitive drum 2*a*.

Thereafter, the yellow toner image on the photosensitive drum 2*a* is primary-transferred onto the intermediary transfer belt 3 by applying a voltage of a polarity opposite the polarity of the toner to a primary transfer roller 4 provided inside the intermediary transfer belt 3.

In this manner, the primary transfer of the yellow toner image is completed, and the rotary 1 is rotated in the direction of arrow B in FIG. 2 by a drive from the drive transmission mechanism of the image forming apparatus 100. The magenta developing cartridge 5*b*, the cyan developing cartridge 5*c*, the black developing cartridge 5*d* are sequentially positioned to the developing position opposing the photosensitive drum 2*a*. Similar to the yellow image, the formations of the magenta, cyan then, black electrostatic latent images, the development by the potential applications between the photosensitive drum 2*a* and the developing rollers 51*b*, 51*c*, 51*d*, the primary transfers are sequentially carried out, and the four color toner images are overlaid on the intermediary transfer belt 3.

During this period, a secondary transfer roller 6 is out of contact relative to the intermediary transfer belt 3 as shown in FIG. 2. A cleaning unit 10 for the intermediary transfer belt 3 is also out of contact relative to the intermediary transfer belt 3.

On the other hand, sheets S (toner image recording member) onto which toner images are transferred are stacked on a feeding cassette 7 provided in a lower portion of the image forming apparatus 100, and are separated and fed out one by one by a feeding roller 8 from the feeding cassette 7 to a pair 9 of the registration rollers. The registration roller pair feeds the sheet S into between the intermediary transfer belt 3 and the secondary transfer roller 6. Here, the secondary transfer roller 6 is press-contacted to the intermediary transfer belt 3 as shown in FIG. 3.

The secondary transfer roller 6 is supplied with a voltage of a polarity opposite the toner, and the four toner images overlaid on the intermediary transfer belt 3 are secondary-transferred onto the surface of the fed sheet S all together.

The sheet S having the transferred toner image is fed to the fixing device 11. In the fixing device 11, the sheet S is heated so that the toner image is fixed on the sheet S. By this, an image is formed on the sheet S, which is discharged to a discharging portion of an upper cover 12 from the fixing device 11.

(Structure of Developing Cartridge)

Referring to FIGS. 4 and 5, the description will be made as to structures of the developing cartridge in the embodiment. The structures of the yellow developing cartridge 5*a*, the magenta developing cartridge 5*b*, the cyan developing cartridge 5*c* and the black developing cartridge 5*d* are all the same. The structure of the yellow developing cartridge 5*a* will be described representing the yellow developing cartridge 5*a*, the magenta developing cartridge 5*b*, the cyan developing cartridge 5*c* and the black developing cartridge 5*d* in this embodiment.

FIG. 4 is a sectional view of the yellow developing cartridge 5*a* in this embodiment before dismounting the developer sealing member 70.

FIG. 5 is a sectional view of the yellow developing cartridge 5*a* in this embodiment after dismounting the developer sealing member 70. FIG. 6 is a schematic perspective view of the yellow developing cartridge 5*a* in this embodiment.

A developing container 55 of the yellow developing cartridge 5*a* is separated into a toner accommodating chamber 56 (developer accommodating portion) and a developer chamber 57. They are divided into the top and lower parts by a toner supply opening 58. The developer chamber 57 is provided with a developing roller 51 which is a developer carrying member for supplying the developer to the photosensitive drum 2*a* and a toner supplying roller 52 to develop the electrostatic latent image formed on the photosensitive drum 2*a*.

In the unused state before the yellow developing cartridge 5*a* reaches the user, the developer sealing member 70 is mounted to the toner supply opening 58. The developer sealing member 70 is a sealing member in the form of a film for separating between the toner accommodating chamber (developer accommodating portion) 56 and the developer chamber (developing roller accommodating portion) 57, and is fixed to the developing container 55 by welding or the like.

In the use, the developer sealing member 70 is removed, and it is mounted to the rotary 1 gripping the grip 54. By removing the developer sealing member 70, the toner 80 in the toner accommodating chamber 56 is let fall into the developer chamber 57 at the developing position where it is opposed to the photosensitive drum as shown in FIG. 5. The toner in the developer chamber 57 is supplied to the toner supplying roller 52. In addition, the toner supplying roller 52 supplies the toner to the developing roller 51 by rotating in the direction of an arrow E. The developing roller 51 comprises an elastic rubber roller and rotates in the direction of an arrow F so that the toner on the developing roller 51 is regulated into a constant thickness by a developing blade 53, and it is used for development on the photosensitive drum 2*a*.

The toner remaining on the developing roller 51 is removed by the toner supplying roller 52. Thereafter, it is supplied to the developing roller 51 by the toner supplying roller 52.

As shown in FIG. 3, in the developing position of the yellow developing cartridge 5*a*, the developing cartridges 5*a*, 5*b*, 5*c*, 5*d* are urged toward the photosensitive drum 2*a* by the rotary 1 supporting them to stably contact the developing roller 51 to the photosensitive drum 2*a*.

By doing so as shown in FIG. 3, the developing roller 51*a* of the yellow developing cartridge 5*a* is in the state that it is contacted to the photosensitive drum 2*a* with a predetermined pressure.

The rotary 1 supporting the developing cartridge 5*a* is swingable about a rotary driving shaft 20, and is pressed by pressing means (unshown) toward the photosensitive drum 2*a* so that the developing roller 51*a* is contacted to the photosensitive drum 2*a*.

(Structure of Developing Roller Protecting Member)

Referring to FIG. 6 through FIG. 8, the description will be made as to structures of a developing roller protecting member 90.

The developing cartridge 5 in this embodiment is provided with the developing roller protecting member 90 to prevent it from damaging the developing roller 51 in handling (FIG. 7)

Opposite longitudinal ends of the developing cartridge 5*a* are provided with side members 60, 61 rotatably supporting the developing roller 51, respectively.

As shown in FIG. 6, one of the side members 60 is provided with a mounting guide 60*b* which functions when mounting and demounting the developing cartridge relative to the rotary, and is provided with grooves 60*d*, 60*e* for locking the protecting member 90. The opposing side member 61 is also provided with a mounting guide 61*b* and a groove portion 61*d*.

The grooves 60*d*, 60*e* are L-shaped to permit movement of the claws 90*d*, 90*e* (FIG. 8) provided on the protecting member 90 in the direction of an arrow X1 (FIG. 7) parallel with the longitudinal direction of the developing roller 51*a*.

As shown in FIG. 1, it is mounted in the main assembly of the image forming apparatus with the protecting member 90 mounted to the developing cartridge 5*a*, and is shipped. It is avoided, during the transportation, that the developing roller protecting member 90 is moved by a strong shock, vibration and the like in a radial direction of the rotary (arrow α in FIG. 1) to fall from the developing cartridge into the main assembly of the image forming apparatus. To accomplish this, a direction X1 in FIG. 7 is made a removing direction of the developing roller protecting member 90.

This is because the movement in the direction parallel with the rotational shaft of the developing roller 51*a* the X1 direction in FIG. 7) is limited therefore, the rotary 1, but there is no member which is effective to limit the movement of the developing roller protecting member 90 against the movement in the radial direction of the rotary (a direction in FIG. 1). Therefore, in this embodiment, it is movable only in the direction parallel with the rotational shaft of the developing roller 51*a*.

(Structure of Developer Sealing Member Grip Portion)

A developer sealing member 70 will be described. As shown in FIG. 4, the developer sealing member 70 has to be removed by the user before start of use of the main assembly of the apparatus.

As shown in FIG. 9 the developer sealing member 70 extends to an outside of the developing cartridge through an opening 60*f* of the side member 60.

The developer sealing member 70 is dismounted by pulling it in the direction of the arrow X1 (axial direction of rotation of the developing roller) in FIG. 9.

Therefore, in consideration of the usability, a grip portion 71 which is a separate part is welded or bonded to the developer sealing member 70 to improve the operationality as shown in FIGS. 9 and 10. It is desirable that the grip portion 71 has a size enough for the user to grip or is provided with an opening 71*b* into which the user's finger can enter.

In this embodiment, the grip portion 71 is bent into a direction perpendicular to (crossing direction) the pulling direction of the developer sealing member 70 (direction of the arrow X1 in FIG. 11), and is closely-contactable to the side member 60 of the developing cartridge 5*a* as shown in FIG. 7.

With the recent downsizing of the image forming apparatus, the developing cartridge is being downsized. As regards the grip portion 71, however, there is a minimum size required since the grip portion 71 is supposed to be gripped, and therefore, the downsizing of the grip portion 71 may result in deterioration of the usability.

If the grip portion 71 is upsized and not bendable, the grip portion 71 is fixed in the state that it is projected in the direction of the rotational shaft of the developing roller, as shown in FIG. 12. In such a case, the length of the developing roller of the developing cartridge becomes long with the possible result of reduction of the transportation efficiency.

In this embodiment, the grip portion 71 is bendable in order to assure enough size of the grip portion 71. By this, the grip portion 71 is deformable between a first position (FIG. 7) in which it extends in a direction substantially perpendicular to the direction of the rotational shaft of the developing roller 51 (crossing direction) and a second position (FIG. 12) in which it is substantially in parallel with the rotational shaft of the developing roller 51. In the first position (bent state), the grip portion 71 (point chain line in (b) of FIG. 8) is so large that it overlaps with the developing roller protecting member 90 as seen form a side perpendicular to the axial direction of the developing roller (hatched region in (b) of FIG. 8).

With such a structure, the grip portion 71 dose not project beyond the side surface (side surface perpendicular to the axial direction of the developing roller in FIG. 8) of the developing cartridge, and therefore, the packaging and transportation efficiencies are not deteriorated.

In addition, the first position of the grip portion 71 is on a movement locus when the protecting member 90 is removed.

(Removing Method of Developing Roller Protecting Member)

A removing method of the developing roller protecting member 90 will be described.

The developing roller protecting member 90 becomes demountable by sliding in the direction of the arrow X1 shown in FIG. 11. At this time, the grip portion 71 is disposed on the movement locus of the developing roller protecting member 90 as described hereinbefore, and a force in the direction of an arrow Z1 is applied to the grip portion 71. The grip portion 71 is provided with an integral hinge portion 71*a* (FIG. 10) and is bendable, and therefore, when it is pushed by the developing roller protecting member 90, it is displaced to the second position which is out of the movement locus of the developing roller protecting member 90. In the second position, the removal movement of the developing roller protecting member 90 is not impeded (is permitted).

The grip portion 71 comprises a thin portion (hinge portion 71*a* of FIG. 10) for easy movability between the first position and the second position. In this embodiment, the grip portion 71 and the hinge portion 71*a* are made of polypropylene resin material.

The grip portion 71 is colored orange for easy visibility by the user.

In this embodiment, a contact surface 90*f* for contact with the grip portion 71 is provided on the developing roller protecting member 90. By contacting the contact surface 90*f* to the hinge portion 71*a*, the movement of the protecting member 90 moves the grip portion 71 from the first position to the second position to a great extent.

Accordingly, the user can easily notice the grip portion 71, and therefore, the removal of the developer sealing member 70 by the user is assured.

As shown in FIG. 13, the side member 60 which is the frame may be provided with an engaging portion 60*g* engageable with a projection 71*c* provided on the grip portion 71, it can be locked in the state that the grip portion 71 is bent. With such a structure, the bended state is maintained during packaging or transportation, and therefore, the handling is easy.

SECOND EMBODIMENT

Referring to FIG. 14 through FIG. 19, a process cartridge and an electrophotographic image forming apparatus according to a second embodiment of the present invention will be described.

FIG. 14 illustrates an electrophotographic image forming apparatus (main assembly of the apparatus) 200 to which a plurality of process cartridges (cartridges) 250*y*, 250*m*, 250*c*, 250*k* are detachably mounted. The cartridges 250*y*, 250*m*, 250*c*, 250*k* contain yellow color toner, magenta color toner, cyan color toner and black color toner (developers). FIG. 15 is a sectional side elevation of the cartridge alone, and FIG. 16 is an illustration when the cartridge 250*k* is mounted to the main assembly of the apparatus 200.

(General Arrangement of Electrophotographic Image Forming Apparatus)

As shown in FIG. 14, in the main assembly of the apparatus 200, a surface of the photosensitive drums 230*y*, 230*m*, 230*c*, 230*k* are exposed to the laser beams 211 on the basis of image signals by a laser scanner 215. The electrostatic latent image is developed by developing rollers 242 shown in FIG. 15 into toner images (developed images) on the respective photosensitive drums. By applying voltages to transfer rollers 218*y*, 218*m*, 218*c*, 218*k*, the toner image are transferred sequentially to a transfer belt 219. Thereafter, the toner image formed on the transfer belt 219 is transferred onto a recording material P fed by a feeding roller 201 which is feeding means, by a transfer roller 203. Subsequently, the recording material P is fed to a fixing unit 206. Here, by applying heat and pressure to the recording material P, the toner image transferred to the recording material P is fixed. Then, the recording material on which the toner image is fixed is discharged to a discharging portion 209 by discharging rollers 207.

(General Arrangement of Cartridge)

Referring to FIG. 15, the description will be made as to the cartridges 250*y*, 250*m*, 250*c*, and 250*k* of this embodiment. Here, cartridges 250*y*, 250*m*, 250*c*, 250*k* have the same structures except for accommodating different color toner particles T, and therefore, the cartridge 250*y* will be described.

The cartridge 250*y* is provided with a photosensitive drum 230*y* and process means actable on the photosensitive drum 230*y*. Here, the process means may include a charging roller 232 as charging means for charging the photosensitive drum 230*y*, a developing roller 242 as developing means for developing a latent image formed on the photosensitive drum 230*y*, and cleaning means 233 including a blade for removing residual toner remaining on the surface of the photosensitive drum 230*y*. The cartridge 250*y* is divided into a drum unit 231 and a developing unit 241.

(Structure of Drum Unit)

As shown in FIG. 15, the drum unit 231 includes the photosensitive drum 230*y*, the charging means 232, the cleaning means 233, a residual toner accommodating portion 235 and a drum frame 234. As shown in FIG. 17, one end portion of the photosensitive drum 230*y* with respect to the direction of the rotational axis thereof is supported rotatably by a supporting portion 236*b* of a covering member 236. As shown in FIG. 17, the other end portion of the photosensitive drum 230*y* is supported rotatably by a supporting portion of a covering member 237. The covering members 236, 237 are fixed to the drum frame 234 at the opposite ends of the drum frame 234. One end portion of the photosensitive drum 230*y* with respect to the rotational axial direction thereof is provided with a coupling member (unshown) for transmitting a driving force to the photosensitive drum 230*y*. The coupling member is engaged with a main assembly coupling member when the cartridge 250*y* is mounted to the main assembly of the image forming apparatus 200.

A driving force is transmitted from a driving motor (unshown) provided in the main assembly of the apparatus 200 to the coupling member, by which the photosensitive drum 230*y* is rotated in the direction of an arrow u as shown in FIG. 15. The charging means 232 is supported by the drum frame 234 so that it is rotated by the photosensitive drum 30. The cleaning means 233 is supported by the drum frame 234 so that it is contacted to the circumference surface of the photosensitive drum 230*y* at a predetermined pressure.

(Structure of Developing Unit)

As shown in FIG. 15, the developing unit 241 comprises the developing roller 242, a developing blade 243 and a developing device frame 248. The developing device frame 248 includes a developer accommodating portion 249 accommodating the developer to be supplied to the developing roller 242, and the developing blade 243 for regulating a toner layer thickness on the peripheral surface of the developing roller 242.

The developing roller 242 is supported rotatably by a bearing unit (unshown). The coupling member is provided on the bearing unit.

When the cartridge 250*y* is mounted to the main assembly of the apparatus 200, a second main assembly coupling member (unshown) and the coupling member provided on the developing unit are engaged with each other, and the driving force is transmitted from the driving motor (unshown) provided in the main assembly of the apparatus 200.

Similarly to the first embodiment, as shown in FIG. 15, a developer sealing member 270 which is a film-like sealing member is mounted to an opening 249*a* for supplying the toner from the developer accommodating portion 249, by welding or the like, thereby to seal the developer accommodating portion 249. Upon use, it is necessary for the user to remove the developer sealing member 270.

As shown in FIG. 17, the developer sealing member 270 extends to an outside of the cartridge through an opening 236*f* of the side covering member 236, and the end thereof is provided with an integral grip portion 271.

The developer sealing member 270 is dismounted by pulling in the direction of the arrow X2 (rotation axial direction of the developing roller 242) in FIG. 18.

(Structure of Protecting Member for Photosensitive Drum)

The cartridge 250*y* is provided with a protecting member 290 for the photosensitive drum in order to prevent damage of the photosensitive drum during transportation and user handling thereof.

As shown in FIGS. 17 and 19, the photosensitive drum protecting member 290 is provided with groove portions 290*d*, 290*e* extending in parallel with the longitudinal direction, for locking with the cartridge 250*y*. The cartridge is provided projections 231*d*, 241*e* (FIG. 15) extending in parallel with the longitudinal direction of the developing roller 51*a*, for engaging with the groove portions 290*d*, 290*e*. By this, the photosensitive drum protecting member 290 is movable only in the direction parallel with the longitudinal direction relative to the cartridge 250*y* in mounting and dismounting.

If an attempt is made to insert the cartridge 250*y* into the main assembly of the apparatus with the photosensitive drum protecting member 290 mounted, the photosensitive drum protecting member 290 hits the main assembly of the apparatus. Therefore, as shown in FIG. 16, when the cartridge 250*y* is inserted into the main assembly of the apparatus along the guide 212, the photosensitive drum protecting member 290 hits the main assembly of the apparatus if the photosensitive drum protecting member 290 has not been removed. With further insertion of the cartridge 250*y*, the photosensitive drum protecting member 290 is stopped by the main assembly of the apparatus 200 but not inserted, and therefore, only the cartridge 250*y* is mounted into the main assembly of the apparatus 200.

(Structure of Developer Sealing Member Grip Portion)

Referring to FIGS. 15 and 16, the structure of the grip portion 271 will be described.

Also in this embodiment, in order to remove the developer sealing member 270, as shown in FIG. 17, the grip portion 271 is mounted to the end of the developer sealing member 270 by welding or bonding, similarly to the first embodiment.

Similarly to the first embodiment, the grip portion 271 is as large as overlying with the photosensitive drum protecting member 290 as seen in the direction perpendicular to the rotation axial direction of the developing roller. This position is a first position which is on the track of the photosensitive drum protecting member 290 when it is removed.

(Removing Method for Photosensitive Drum Protecting Member)

A removing method for the photosensitive drum protecting member 290 will be described.

The photosensitive drum protecting member 290 is dismounted by sliding in the direction of the arrow X2 shown in FIG. 18 before use of the cartridge 250*y*. At this time, as described above, the grip portion 271 exist on the movement track of the photosensitive drum protecting member 290, so that the grip portion 271 is pushed when the photosensitive drum protecting member 290 is removed, thus moving in the direction of an arrow Z2.

And, the grip portion 271 moves to the position where it is not overlying on the track of the grip portion 271 when the photosensitive drum protecting member 290 is removed. This is the second position where the movement of the protecting member 290 is not impeded. Therefore, the grip portion 271 does not prevent dismounting of the photosensitive drum protecting member 290.

Similarly to the first embodiment, the grip portion 271 is made of polypropylene resin material, and is provided with a hinge portion to permit movement between the first position and the second position.

As described in the foregoing, according to the present invention, since the grip portion can take the first position, the grip portion can be maximized to improve the operativity without sacrificing the conveniences for the packaging or transportation.

When the protecting member is removed, the interference of the grip portion occurs, and therefore, the grip portion can be assuredly removed.

THIRD EMBODIMENT

General Arrangement of Image Forming Apparatus

FIG. 20 is a perspective view of an outer appearance of an image forming apparatus 100 according to this embodiment. FIG. 21 is a left-hand side sectional view of the image forming apparatus 100.

In the following description, a front side of the image forming apparatus 100 is the side where a cassette 7 for the recording material is mounted and dismounted. D A rear side is a side opposite therefrom. Frontward and rearward directions are a direction from the rear side toward the front side (frontward direction) and a direction (backward direction) opposite thereto. Left and right are left or right as seen from the front side. Left and light directions are a direction from the right to the left (leftward direction) and a direction opposite thereto (rightward direction). One end, with respect to, a longitudinal direction (axial direction) of the electrophotographic photosensitive drum which is the image bearing member is a drive side, and the other end is a non-driving side. A main assembly of the apparatus 100A is an image forming apparatus portion other than developing cartridges 5 (5*a*, 5*b*, 5*c*, 5*d*).

The image forming apparatus 100 of this embodiment a four color (full color) laser beam printer (color electrophotographic image forming apparatus the. It forms an image on a recording material (recording material) 40 on the basis of a electrical image signal inputted to a control circuit portion (control means CPU) 200 from a host apparatus 300 such as a personal computer, an image reader, a sender facsimile machine or the like. The recording material 40 is a recording paper sheet, an OHP sheet, a label or the like. The control circuit portion 200 exchange various electrical information between a host apparatus 300 and an operating portion 400, and effects overall control for the image forming operation of the image forming apparatus 100 in accordance with a predetermined control program and/or a predetermined look-up table. Therefore, the image forming operation which will be described hereinafter is controlled by the control circuit portion 200.

The image forming apparatus 100 is provided therein with the electrophotographic photosensitive drum (drum) 2*a* as a rotatable image bearing member. The drum 2*a* is rotated at a predetermined speed (process speed) in the counterclockwise direction of a broken line arrow B by a driving mechanism (unshown). Around the drum 2*a*, there are provided process means actable on the drum 2*a*. In this embodiment, the process means include charging means 2*b* for charging uniformly the drum 2*a*, exposure means 15 for selectively exposing the uniformly charged surface of the drum 2*a* to form an electrostatic latent image, and developing means 50 for visualizing the electrostatic latent image with a developer (toner). There is also provided drum cleaning means 2*c* for removing primary untransferred residual toner on the drum 2*a*.

In this embodiment, the charging means 2*b* is a contact type charging roller. The exposure means 15 is a laser scanner unit.

The developing means 50 is of a rotary type including a rotatable rotary 1 for supporting developing cartridges 5*a*, 5*b*, 5*c*, and 5*d* to move each developing cartridge sequentially to a developing position. In this embodiment, four developing cartridges 5*a*, 5*b*, 5*c*, 5*d* are provided for yellow, magenta, cyan and black colors (four colors) for visualizing the electrostatic latent images formed on the drum 2*a*. The yellow developing cartridge 5*a* accommodates yellow (Y) toner. The magenta developing cartridge 5*b* accommodates the magenta (M) toner. The cyan developing cartridge 5*c* accommodates cyan (C) toner. The black developing cartridge 5*d* accommodates black (Bk) toner. The rotary 1 is rotatable about a rotation shaft (center supporting shaft) 1*a*. As shown in FIG. 24, a rotational force driven by a drive transmission mechanism (electric rotary driving mechanism) M is transmitted to rotary gears G2 (G2L, G2R) through drive gears G1 (G1L, G1R). By this, the rotary 1 is rotated about the rotation shaft 1*a* in the clockwise direction indicated by a broken line arrow C. The rotation of the rotary 1 in the clockwise direction C is a forward rotational direction (rotational direction during image formation). The control circuit portion 200 controls the drive transmission mechanism M to control rotation of the rotary 1 for every predetermined angular positions.

The drum cleaning means 2*c* employs a cleaning blade as a cleaning member for removing the untransferred toner (untransferred residual developer) from the drum 2*a*. The toner removed from the surface of the drum 2*a* by the blade 2*c* is accommodated in a cleaner container 2*d*.

In this embodiment, the drum 2*a*, the charging means 2*b*, the drum cleaning means 2*c*, 2*d* are unified into a cartridge which is a drum cartridge 2 detachably mountable to a predetermined mounting portion of the main assembly of the apparatus 100A of the image forming apparatus 100 in a predetermined manner. The drum 2*a*, the charging means 2*b* and the drum cleaning means 2*c*, 2*d* may be separate or unified.

Below the drum cartridge 2 and the developing means 50, there is provided an intermediary transfer member unit 3A as transferring means. The unit 3A includes an endless intermediary transfer belt (belt) 3, as an intermediary transfer member, which is of dielectric member and is flexible. It includes a secondary transfer opposing roller 3*a*, a primary transfer roller 4, a belt driving roller 3*b* and a tension roller 3*c* which support and stretch the belt 3 around them. The primary transfer roller 4 is opposed to the drum 2*a* with the belt 3 therebetween. A contact portion between the drum 2*a* and the belt 3 is a primary transfer nip T1. The belt driving roller 3*b* is driven, by which the belt 3 is circulated at a speed corresponding to a rotational speed of the drum 2*a* in the clockwise direction indicated by a broken line arrow A.

At the belt training portion of the secondary transfer opposing roller 3*a*, a secondary transfer roller 6 is provided. The secondary transfer roller 6 is movable by a moving mechanism (unshown) between an operating position indicated by broken lines where it is urged toward the secondary transfer opposing roller 3*a* with the belt 3 therebetween, and a non-operating position indicated by solid lines where it is spaced from the belt 3. Normally, it is kept in the non-operating position. It is moved to the operating position at predetermined control timing. In the state that the secondary transfer roller 6 is in the operating position, the contact portion between the secondary transfer roller 6 and the belt 3 is a secondary transfer nip T2.

In the belt training portion of the secondary transfer opposing roller 6, a belt cleaner 10 as belt cleaning means is provided downstream of the secondary transfer roller 6 with respect to the belt moving direction. The belt cleaner 10 is a means for removing after-secondary-transfer residual toner from the surface of the belt 3. The belt cleaner 10 is movable between a broken line operating position where the cleaning member contacts to the surface of the belt 3 by a moving mechanism (unshown), and a solid line non-operating position where the cleaning member is spaced from the belt 3. Normally, it is kept in the non-operating position. It is moved to the operating position at predetermined control timing.

Below the intermediary transfer member unit 3A, there is provided a recording material feeding unit 7A. The unit 7A includes a sheet feeding cassette 7 stacking the recording materials 40, a sheet feeding roller 8, and a separation pad 8*a*. The sheet feeding cassette 7 can be accessed from the front side of the image forming apparatus 100 (front loading). Designated by reference numeral 7*a* is a grip portion provided on the front side.

In the rear side of the main assembly of the apparatus 100A, there is provided a recording material feeding path (feeding means) 7*b* for feeding the recording material, which extends upwardly from the portion of the sheet feeding roller 8 of the recording material feeding unit 7A. Along the recording material feeding path 7*b* from the bottom to the top, there are provided a pair of registration rollers, the secondary transfer roller 6, the fixing device 11, a pair of sheet discharging rollers 7*c* and a discharge opening 7*d*. The fixing device 11 includes a fixing roller 11*a* and a pressing roller 11*b*. The upper surface of the main assembly of the apparatus 100A constitutes a sheet discharge portion (sheet discharge tray) 12. The upper surface of the main assembly of the apparatus is provided with mounting and demounting cover (upper side cover) 13 which can be opened and closed about a hinge shaft 13*a*. Designated by 13*b* is a grip portion provided on the cover 13. The cover 13 functions as an extension tray of the sheet discharge portion 12 continuous with the sheet discharge portion 12. The recording material 40 on which the image has been formed is discharged onto the sheet discharge portion 12 and the cover 13 through the discharge opening 7*d* from the pair of sheet discharging rollers.

The operation of forming the full-color image is as follows. FIG. 21 shows the stand-by state of the image forming apparatus. The rotary 1 is retained in the home position angular position in which the yellow developing cartridge 5*a* faces to the front (rightward direction in FIG. 20). In such a state, the control circuit portion 200 waits for an image formation start signal.

When the image formation start signal is produced, the control circuit portion 200 actuates a main motor (unshown) to start rotation for the drum 2*a*. The drive transmission mechanism M is driven to rotate the rotary 1 by the driving shaft 21, gears G1 and G2 about the rotation shaft 1*a* from the home position angular position of FIG. 21 in the forward rotational direction C through a predetermined angle, approx. 45° in this embodiment, and is stopped there. By the rotation of the rotary 1, the yellow developing cartridge 5*a* moves to the developing position opposing the drum 2*a* as shown in FIG. 22. That is, the developing roller 51*a* of the yellow developing cartridge 5*a* is contacted to the drum 2*a*.

In this embodiment, the developing position of the developing cartridge relatively to the drum 2*a* is a position where the developing roller 51 which is a developer carrying member for carrying and supplying the toner to the drum 2*a* is opposed and contacted to the drum 2*a* in a predetermined fashion. In order to contact the developing roller 51 to the drum 2*a* stably in the developing position, the rotary 1 is urged toward the drum 2*a* about the driving shaft 21. By doing so, the developing roller 51 of the developing cartridge 5 in the developing position is contacted to the drum 2*a* at a predetermined pressure. As will be described hereinafter, the rotary 1 carrying the developing cartridge is swingable about the driving shaft 21. And, it is urged toward the drum 2*a* by pressing means (unshown) to contact the developing roller 51 of the developing cartridge placed in the developing position to the drum 2*a* with a predetermined urging force. The driving shaft 21 and the drive gear G1 are coaxial with each other. Here, the contact between the developing roller 51 and the drum 2*a* does not exclude opposing of the developing roller 51 to the drum 2*a* with a predetermined small gap by spacer rollers (unshown) provided at the opposite ends of the developing roller 51 contacting of the respective opposite ends of the drum 2*a*.

As shown in FIG. 22, the yellow developing cartridge 5*a* in the developing position is supplied with the driving force and with a developing bias voltage from the main assembly of the apparatus 100A. Also, the laser scanner unit 15 is actuated. In addition, the belt 3 is also driven. The secondary transfer roller 6 and the belt cleaner 10 are maintained at the non-operating positions spaced from the belt 3. A predetermined charging bias voltage is applied to the charging roller 2*b*. By this, the surface of the rotating drum 2*a* is charged uniformly to the predetermined polarity and potential. The laser scanner unit 15 outputs a laser beam modulated corresponding to a Y color component image signal of the full-color image, by which the charged surface of the drum 2*a* is scanningly exposed to the laser beam. By this, an electrostatic latent image corresponding to the Y color component image is formed on the surface of the drum. The electrostatic latent image is developed into a Y color toner image by the yellow developing cartridge 5*a*. In this embodiment, the electrostatic latent image is reversely developed with negative charged toner having the same polarity as the charge polarity of the drum 2*a*. The developing roller 51*a* is supplied with a voltage (developing bias voltage) of the same polarity as the charge polarity of the drum 2*a* so that the yellow toner is deposited on the electrostatic latent image formed on the drum 2*a*. The Y color toner image is transferred (primary transfer) onto a surface of the belt 3 in the primary transfer nip T1. The primary transfer roller 4 the supplied with a primary transfer bias of a predetermined potential and a polarity opposite the charge polarity of the toner at predetermined control timing. The surface of the drum 2*a* after the primary transfer is cleaned by a cleaning blade 2*c*.

After the completion of the primary transfer of the Y color toner image onto the belt 3, the control circuit portion 200 operates the drive transmission mechanism M to rotate the rotary 1 in the forward rotational direction C through a predetermined angle, approx. 90° in this embodiment and stop it there. By this, the magenta developing cartridge 5*b* is moved to and positioned at the developing position relative to the drum 2*a*, then. That is, the developing roller 51*b* of the magenta developing cartridge 5*b* is opposed to and contacted to the drum 2*a*. The charging, exposing and developing steps are executed to the drum 2*a* to form a M color toner image corresponding to a M color component image of the full-color image. In the primary transfer nip T1, the M color toner image is primary transferred superimposedly on the Y color toner image already transferred on the belt 3 with a predetermined alignment state.

After the completion of the primary transfer of the M color toner image onto the belt 3, the control circuit portion 200 operates the drive transmission mechanism M to rotate the rotary 1 in the forward rotational direction C through a predetermined angle, approx. 90° in this embodiment and stop it there. By this, the cyan developing cartridge 5*c* is moved to and positioned at the developing position relative to the drum 2*a*, then. That is, the developing roller 51*c* of the cyan developing cartridge 5*c* is opposed to and contacted to the drum 2*a*. The charging, exposing and developing steps are executed to the drum 2*a* to form a C color toner image corresponding to a C color component image of the full-color image. In the primary transfer nip T1, the C color toner image is primary transferred superimposedly on the Y+M toner images already transferred on the belt 3 with a predetermined alignment state.

After the completion of the primary transfer of the C color toner image onto the belt 3, the control circuit portion 200 operates the drive transmission mechanism M to rotate the rotary 1 in the forward rotational direction C through a predetermined angle, approx. 90° in this embodiment and stop it there. By this, the black developing cartridge 5*d* is moved to and positioned at the developing position relative to the drum 2*a*, then. That is, the developing roller 51*d* of the black developing cartridge 5*d* is opposed to and contacted to the drum 2*a*. The charging, exposing and developing steps are executed to the drum 2*a* to form a Bk color toner image corresponding to a Bk color component image of the full-color image. In the primary transfer nip T1, the Bk toner image is primary transferred superimposedly on the Y+M+C toner image already transferred on the belt 3 with a predetermined alignment state.

In this manner, a full color image including the Y+M+C+Bk toner images (unfixed) is formed in combination on the belt 3.

The order of the colors of the image formations on the drum 2*a* is not limited to the Y-M-C-Bk order in this embodiment is not restrictive, and another order is usable.

The secondary transfer roller 6 is moved to the operating position contacting to the belt 3 before a leading end portion of the image of the unfixed full color toner image formed on the belt 3 reaches the position of the secondary transfer roller 6 by movement of the belt 3. In addition, the belt cleaner 10 is also moved to the operating position relative to the belt 3. FIG. 23 shows such a state. In FIG. 23, the black developing cartridge 5*d* is positioned in the developing position relative to the drum 2*a*.

On the other hand, the sheet feeding roller 8 is driven at predetermined control timing. By this, one of the recording materials 40 stacked in the sheet feeding cassette 7 is separated and fed out by the cooperation of a roller 8 and a separation pad 8*a*. The recording material 40 is introduced, by the pair of registration rollers 9 at predetermined control timing, into the secondary transfer nip T2 which is a contact portion between the secondary transfer roller 6 and the belt 3. The secondary transfer roller 6 is supplied with a secondary transfer bias of a predetermined potential and a polarity opposite the charge polarity of the toner. By this, in the process of, the recording material 40 being nipped and fed in the secondary transfer nip T2, the four color toner image is secondary transferred all together onto the recording material 40.

The recording material 40 is separated from the surface of the belt 3 and is introduced into the fixing device 11, and it is heated and pressed by a fixing nip. By this, the color toner image is fixed (melting color mixture) on the recording material 40. The recording material 40 is discharged from the fixing device 11 and is discharged onto the sheet discharge portion 12 and the cover 13 through the discharge opening 7*d* by the sheet discharging roller pair 7*c* as a full-color print.

The after-secondary-transfer residual toner remaining on the surface of the belt 3 after the separation of the recording material is removed by the belt cleaner 10.

More particularly, the rotary 1 supporting the developing cartridges 5*a*, 5*b*, 5*c*, and 5*d* for different color developments is rotated through predetermined angles to the developing position where one of the developing cartridges is opposed to the drum 2*a*. The developing cartridge develops the electrostatic latent image formed on the drum 2*a* into the toner image (developed image). The operation is carried out repeatedly using the developing cartridges to form a color image on the recording material 40 by way of the intermediary transfer member 3.

An image formation job for one sheet or for continuous sheets are completed, the image forming apparatus 100 is returned by the control circuit portion 200 to the stand-by state of FIG. 21 and waits for the next image formation start signal. That is, the drum 2*a*, the laser scanner unit 15, the belt 3 and so on is stopped. The secondary transfer roller 6 and the belt cleaner 10 are moved to the non-operating positions. The rotary 1 is rotated to return to the home position angular position and is kept in the stand-by state there.

In the case of a monochromatic image forming mode, the image formation is effected only by the black developing cartridge 5*d*. A monochromatic image formation job for one sheet or for continuous sheets are completed, the image forming apparatus 100 is returned by the control circuit portion 200 to the stand-by state of FIG. 21 and waits for the next image formation start signal.

(Rotary)

Referring to FIG. 24, structures of the rotary 1 in this embodiment will be described. As shown in (a) of FIG. 24, the rotary 1 comprises a rotation shaft 1*a*, and a pair of disks (left and right disk-like side plates) 31L, 31R mounted concentrically and integrally to the left-hand end portion and the right-hand end portion of the rotation shaft 1*a*. On the inner surface on each of the left and right disks 31L, 31R, four mounting portions for detachably supporting the opposite longitudinal ends of the developing cartridges 5*a*, 5*b*, 5*c*, 5*d* at regular intervals of approx. 90°. Between the left and right opposing side plate of the main frame 100B of the main assembly of the apparatus 100A, the driving shaft 21 is provided rotatably through bearing members (unshown). The left-hand end portion and the right-hand end portion of the driving shaft 21 are provided with rotatable suspending arm members 32L, 32R, respectively. Between the left and right suspending arm members 32L, 32R, the rotation shaft 1*a* is rotatably supported to support the rotary 1. As shown in FIGS. 21, 22, and (b) of FIGS. 23, 24, to the predetermined mounting portions between the left and right disks 31L, 31R of the rotary 1, four developing cartridges 5*a*, 5*b*, 5*c*, 5*d* are gathered substantially in a cylindrical form and are detachable. Outer circumferences of the left and right disks 31L, 31R are formed into rotary gears G2L, G2R. The left-hand end portion and the right-hand end portion of the driving shaft 21 are provided with drive gears G1L, G1R, respectively. The left side drive gear G1L is in meshing engagement with the left side rotary gear G2L, and the right-hand side drive gear G1R is in meshing engagement with the right-hand side rotary gear G2R. The driving shaft 21 is rotated by the drive transmission mechanism M controlled by the control circuit portion 200.

With such a structure, when the driving shaft 21 is driven by the drive transmission mechanism M in a predetermined direction, the rotational force of the driving shaft 21 is transmitted to the rotary gears G2L, G2R through the drive gears G1L, G1R. By this, the rotary 1 is rotated about the rotation shaft 1*a* in the forward rotational direction C. The control circuit portion 200 controls the drive transmission mechanism M to control rotation of the rotary 1 for every predetermined angular positions.

The rotary 1 is suspended relative to the driving shaft 21 through the suspending arm members 32L, 32R, and therefore, is swingable about the driving shaft 21 in the counterclockwise direction indicated by an arrow d and in the clockwise direction indicated by an arrow e opposite thereto. The swing of the rotary 1 in the counterclockwise direction d is toward the drum 2*a*, and the swing in the counterclockwise direction e is away from the drum 2*a*. And, the rotary 1 is urged in the counterclockwise direction indicated by an arrow d about the driving shaft 21 by a pressing means (unshown) such as a spring. By the urging, the developing roller 51 of the developing cartridge moved to the developing position by the indexing rotation of the rotary 1, thereby to contact to the drum 2*a* uniformly. That is, the developing roller 51 is in contact with the drum 2*a* at a predetermined pressure.

The left and right drive gears G1L, G1R engaged with the left and right G2L, G2R of the rotary 1 are coaxial with the driving shaft 21, an axis of which is the center of the swing motion of the rotary 1. Therefore, even if the rotary 1 swings, the engagement with the left and right rotary gears G2L, G2R is maintained.

As described hereinbefore, the rotary 1 supports the yellow developing cartridge 5*a*, the magenta developing cartridge 5*b*, the cyan developing cartridge 5*c* and the black developing cartridge 5*d* at the regular interval of approx. 90°, substantially in the form of a cylinder. The structures of the rotary 1 for supporting the developing cartridges 5*a*, 5*b*, 5*c*, and 5*d* are all the same. Therefore, the structure for supporting the developing cartridge will be described only with respect to the yellow developing cartridge 5*a*. Referring to FIG. 21 through FIG. 23, when the yellow developing cartridge 5*a* is mounted to the rotary 1, a portion-to-be-locked 16*a* provided on the yellow developing cartridge 5*a* is engaged with a locking portion 17*a* provided on the rotary 1. By this, the yellow developing cartridge 5*a* is prevented from disengaging from the rotary 1. The locking portion 17*a* is urged by coil springs 18*a* (FIGS. 21, 32 and 35-37) in the direction of engagement with yellow developing cartridge 5*a* (direction of an arrow D.) The magenta developing cartridge 5*b*, the cyan developing cartridge 5*c* and the black developing cartridge 5*d* are provided with the portions-to-be-locked 61*cb*, 61 *cc*, 61*cd*, respectively. The portions-to-be-locked 16*b*, 16*c*, 16*d* are engaged with the locking portions 17*b*, 17*c*, and 17*d*. By doing so, the magenta developing cartridge 5*b*, the cyan developing cartridge 5*c* and the black developing cartridge 5*d* are prevented from disengaging from the rotary 1.

(Structure of Developing Cartridge)

The structures of the yellow developing cartridge 5*a*, magenta developing cartridge 5*b*, cyan developing cartridge 5*c* and black developing cartridge 5*d* are the same except for the colors of the toner contained therein.

When the developing cartridges 5*a*, 5*b*, 5*c*, 5*d* are shipped and transported, it is desired that the factors which may cause surface damage of the developing roller 51 or image defect are removed. In view of this, when the developing cartridges 5*a*, 5*b*, 5*c*, 5*d* are shipped and transported, a covering member is mounted to protect the developing roller 51. FIG. 25 is a perspective view of the developing cartridge in the state that the covering member 62 is mounted, and (a) and (b) of FIG. 26 are enlarged views of the developing cartridge of FIG. 25 at one longitudinal end portion and the other end portion, respectively. FIG. 27 is an enlarged schematic cross-sectional view of the central portion, with respect to the longitudinal direction, of the developing cartridge of FIG. 25. FIG. 28 is a perspective view of the developing cartridge and the covering member 62 in the state that the covering member 62 is removed. FIG. 29 is an enlarged schematic cross-sectional view of the developing cartridge in the state that the toner seal is removed and the covering member 6 is removed.

Referring to FIG. 27, the developing cartridges 5*a*, 5*b*, 5*c*, and 5*d* comprises a developing container 55. The developing container 55 is divided into a toner accommodation chamber 56 and a developer chamber 57 provided with the developing roller 51 and the toner supplying roller 52, and they are separated by a toner supply opening 58. The developing roller 51 and the toner supplying roller 52 are rotatably supported by a cartridge frame 64. In the unused state before the developing cartridges 5*a*, 5*b*, 5*c*, 5*d* reach the user, a toner seal 59 in the form of film is fixed to the developing container 55 to seal the toner supply opening 58, thus separating the toner accommodation chamber 56 and the developer chamber 57 from each other. In addition, a covering member 62 is mounted to protect the developing roller 51.

Before the user uses the developing cartridges 5*a*, 5*b*, 5*c*, 5*d*, the user removes the toner seal 59 in a predetermined manner (unsealing). By the removal of the toner seal 59, the toner 63 in the toner accommodation chamber 56 enters the developer chamber 57. In the state that the toner seal 59 has been removed, and the covering member 62 has been removed, the developing cartridges 5*a*, 5*b*, 5*c*, 5*d* are mounted to predetermined mounting portions of the rotary 1. The developing cartridge is moved to the developing position by the rotation of the rotary 1 and is positioned there, and in the state, the toner 63 in the toner accommodation chamber 56 falls into the developer chamber 57 through the toner supply opening 58. The developing cartridge is supplied with the driving force and the developing bias voltage. By this, the toner supplying roller 52 rotates in the direction of an arrow E in FIG. 29 to feed the toner 63 to the developing roller 51. The developing roller 51 comprises an elastic rubber roller and rotates in the direction of an arrow F, and the toner 63 on the developing roller 51 is regulated into a predetermined thickness by the developing blade 53, and is supplied to the drum 2*a* at the developing position. The developing bias voltage is applied to the developing roller 51. By doing so, the electrostatic latent image on the drum 2*a* is developed into a toner image. The toner 63 remaining on the developing roller 51 is removed by the toner supplying roller 52. Thereafter, it is supplied to the developing roller 51 by the toner supplying roller 52.

As shown in FIG. 28, the developing cartridges 5*a*, 5*b*, 5*c*, 5*d* is exposed from the cartridge frame 64 at the exposed portion 51*e* of the developing roller 51. It is contacted to the drum 2*a*. As will be described hereinafter, the image forming apparatus is shipped in the state that the developing cartridges 5*a*, 5*b*, 5*c*, 5*d* are mounted to the rotary 1 (mounted and packaged).

When the user uses the image forming apparatus, the developing cartridges 5*a*, 5*b*, 5*c*, 5*d* mounted to the rotary 1 are removed, and the toner seals 59 are removed. In such an operation, a covering member 62 is required in order to protect assuredly the exposed portion 51*e* of the developing roller 51. The covering member 62 is mounted to the cartridge frame 64 and is demountable in the direction of the axis of the developing roller 51. In the initial installation, the developing cartridge mounted to the rotary 1 is moved, and the toner seal 59 is removed from the developing cartridge, and thereafter, the covering member 62 is moved from the developing cartridge, and then is remounted to the rotary 1. These manipulations are required.

One end portion of the developing roller 51 is provided with a side member 60 constituting a part of the cartridge frame 64. Similarly, the other end portion is provided with a side member 61. The covering member 62 is provided with a first locking portion 62*e*, second locking portion 62*f*, third locking portion 62*g*, a fourth locking portion 62*h*. On the other hand, the side member 60 is provided with a first portion-to-be-locked 60*a* and a second portion-to-be-locked 60*b*. In addition, the side member 61 is provided with a third portion-to-be-locked 61*a* and a fourth portion-to-be-locked 61*b*.

Here as shown in FIG. 25, when the covering member 62 is moved in the direction of an arrow M (in the Figure) which is the axial direction of the developing roller 51, the first locking portion 62*e* and the second locking portion 62*f* are engaged with the first portion-to-be-locked 60*a* and the second portion-to-be-locked 60*b*, respectively. Similarly, the third locking portion 62*g* and the fourth locking portion 62*h* are engaged with the third portion-to-be-locked 61*a* and the fourth portion-to-be-locked 61*b*, respectively. By this, the covering member 62 is mounted to the developing cartridge. On the other hand, when the covering member 62 is moved in the direction of an arrow N in the Figure, each locking portion is unlocked so that the covering member 62 is removed from the developing cartridge.

Here, the portion-to-be-locked is provided on the side member, but this structure is not restrictive, and the portion-to-be-locked may be provided on any proper portion of the cartridge frame constituting the developing cartridge. In addition, two pairs of the portion-to-be-locked and the locking portion are provided at opposite ends of the developing roller 51, but this is not restricted, and what is necessary is to lock the covering member with the developing cartridge assuredly.

(Developing Cartridge Exchanging System)

From each of the developing cartridges 5*a*, 5*b*, 5*c*, 5*d*, the toner 63 is consumed with use for the image formation. Under the circumstances, the developing cartridge is provided with detecting means (unshown) for dictating a remaining amount of the toner 63 in the developing cartridge. The control circuit portion 200 compares the remaining amount value detected by the detecting means with a preset developing cartridge lifetime forenotice or a preset lifetime warning. As for the developing cartridge in which the amount of the remaining toner 63 is smaller than the threshold level, the control circuit portion 200 controls the display portion 400*a* of the operating portion 400 to display a lifetime forenotice or lifetime warning for the developing cartridge. By doing so, the user is prompted to prepare the developing cartridge to exchange, or to exchange the developing cartridge.

A mounting and demounting cover 13 provided in the upper surface of the main assembly of the apparatus 100A is rotated about the hinge shaft 13*a* in the opening direction as shown in FIGS. 30 and 31, by which an opening P of the main assembly of the apparatus 100A opens widely. FIG. 32 is a partial enlarged view of FIG. 31. The opening P is an opening for permitting mounting and demounting of the developing cartridge relative to the rotary 1. More particularly, when the user mounts the developing cartridge to the mounting portion of the rotary 1 or when the user dismounts the developing cartridge from the mounting portion of the rotary 1, the user grips the developing cartridge and removes it through the opening P. The opening P is disposed in the front side beyond the sheet discharge portion 12. The mounting and demounting cover 13 is movable about the hinge shaft 13*a* between a closing position for closing the opening P and an opening position for opening the opening P. The mounting and demounting cover 13 is closed normally, and when the developing cartridge is mounted and demounted, the user opens. When the mounting and demounting cover 13 is opened, the opening P is opened. Through the opening P, a mounting and demounting passage portion 37 for the developing cartridge to the rotary 1 in the main assembly of the apparatus can be seen. The passage portion 37 is provided between the opening P and the rotary 1 with a mounting and demounting guide 14 which is curved into a concave surface. The passage portion 37 is disposed above the drum 2*a*.

The back side of the mounting and demounting cover 13 is provided with projections 13*c*L, 13*c*R on the left side and right-hand side of the cover, respectively. The left side and the right-hand side of the rotary driving shaft 21 is provided with rotatable engagement-release members 20L, 20R which is swingable. When the mounting and demounting cover 13 is closed, the rotatable engagement-release members 20L, 20R are urged by the projections 13*c*L, 13*c*R to keep a developing cartridge engaging position relative to the rotary 1 against an urging spring (unshown). The chain line in FIG. 32 indicates the rotatable engagement-release members 20L, 20R rotated to the developing cartridge engaging position. When the mounting and demounting cover 13 is opened, the rotatable engagement-release members 20L, 20R are released from the projections 13*c*L, 13*c*R to rotate to a developing cartridge releasing position relative to the rotary 1 by the urging force of the urging spring about the shaft 21. The solid line in FIG. 32 depicts the rotatable engagement-release members 20L, 20R rotated to the developing cartridge releasing position.

Except for the duration of image forming operation, the rotary 1 has been rotated about the rotation shaft 1*a* to a phase in which the developing roller 51 of the developing cartridge is away from the drum 2*a* and is kept there. In this embodiment, as shown in FIG. 21, the angle of rotation with which the yellow developing cartridge 5*a* faces front the (rightward direction in FIG. 21) is the home position angular position, and is kept there. The home position angular position of the rotary 1 is 45° upstream of the developing position of the yellow developing cartridge 5*a* with respect to the forward rotational direction of the rotary. The home position angular position of the rotary 1 is also the mounting and demounting position in which each developing cartridge is mountable and dismountable relative to the rotary 1.

In the stand-by state of image forming apparatus 100 of FIG. 21, as shown in FIGS. 30 and 31, the mounting and demounting cover 13 of the main assembly of the apparatus 1A is opened about the hinge portion 13*a*. Then, the user's hand can access to the developing cartridge placed in the mounting and demounting position on the rotary 1 through the opening P of the upper portion of the main assembly of the apparatus 100A.

By the mounting and demounting cover 13 being opened, as described hereinbefore, the rotatable engagement-release members 20L, 20R swing to the developing cartridge releasing position. In other words, by the mounting and demounting cover 13 being opened, the rotatable engagement-release members 20L, 20R are rotated about the shaft 21 in the direction of an arrow I by the urging force of the urging spring, as shown in FIG. 32. A projection 20*a* provided on the rotatable member 20L, 20R urges the releasing slidable member 19*a* of the yellow developing cartridge 5*a* situated at the mounting and demounting position in the direction of an arrow J. Therefore, the locking portion 17*a* moves in the direction of an arrow G against the urging force of the coil spring 18*a* to release the engagement between the portion-to-be-locked 16*a* and the locking portion 17*a*. By doing so, only the yellow developing cartridge 5*a* situated at the mounting and demounting position is released from the mounting portion of the rotary 1.

Then, If exchange of the yellow developing cartridge 5*a* is intended, the user inserts the hand through the opening P into the passage portion 37 and grips the grip 54 of the yellow developing cartridge 5*a* which is released from the rotary 1 in the mounting and demounting position. Then, the user lifts the yellow developing cartridge 5*a* along the mounting and demounting guide 14 and takes it out of the main assembly of the apparatus 100A through the opening P along the passage portion 37. Designated by K is a dismounting direction of the developing cartridge.

Then, the user removes the toner seal 59 and removes the covering member 62 from the new yellow developing cartridge 5*a*, and grips the grip 54 and insert it into the passage portion 37 through the opening P and further toward the rotary 1 along the mounting and demounting guide 14. The user inserts and mounts the yellow developing cartridge 5*a* to the yellow development cartridge mounting portion of the rotary 1 taking the mounting and demounting position. Designated by L is an insertion mounting direction for the developing cartridge. Then, the user closes the mounting and demounting cover 13. By closing the mounting and demounting cover 13, as described hereinbefore, the rotatable engagement-release member 20L, 20R swings to the developing cartridge engaging position. More particularly, by the closing of the mounting and demounting cover 13, the rotatable engagement-release member 20L, 20R is urged by the projection 13*c*L, 13*c*R to rotate about the shaft 21 in the direction opposite the direction of arrow I in FIG. 32 against the urging force of the urging spring. The projection 20*a* provided on the rotatable engagement-release member 20L, 20R moves in the direction opposite the direction of the arrow J away from the releasing slidable member 19*a* of the yellow developing cartridge 5*a* positioned at the mounting and demounting position. Therefore, the locking portion 17*a* is moved in the direction opposite the direction of the arrow G by the urging force of the coil spring 18*a* so that the portion-to-be-locked 16*a* is engaged with the locking portion 17*a*. By this, the yellow developing cartridge 5*a* in the mounting and demounting position is engaged with the rotary 1.

The mounting and demounting of the yellow developing cartridge 5*a* is carried out in the stand-by state. As for the other magenta developing cartridge 5*b*, cyan developing cartridge 5*c* and black developing cartridge 5*d*, they are mountable and dismountable at the mounting and demounting positions which are 45° upstream of the developing position with respect to the forward rotational direction C of the rotary. More particularly, the mounting and demounting cover 13 is opened, and the rotary 1 is manually rotated in the forward rotational direction C or is rotated in the positive rotational direction C by the drive transmission mechanism M, and then the developing cartridge to be replaced is positioned to the mounting and demounting position. The developing cartridge in the mounting and demounting position is released from the rotary 1 by the rotatable member 20L, 20R which has swung to the developing cartridge releasing position by the mounting and demounting cover 13 being opened. In other words, the developing cartridge is released from the rotary 1 by movement of the locking portion to the non-engaging position by the rotatable engagement-release member 20L, 20R taking the developing cartridge releasing position. Therefore, the developing cartridge can be exchanged in the same manner as with the yellow developing cartridge 5*a*.

A rotating force by the urging spring of the rotatable member 20L, 20R toward the developing cartridge releasing position is smaller than the rotary rotational force when the rotary 1 is rotated in the forward rotational direction C in order to move the developing cartridge to the mounting and demounting position. Therefore, the rotatable engagement-release member 20L, 20R urging the releasing slidable member 19*a* of the developing cartridge is rotated in the direction opposite from the developing cartridge releasing position by the rotating rotary 1 to rides on an outer surface of the next developing cartridge. By this, the urging of the releasing slidable member for locking the developing cartridge in the mounting and demounting position to the rotary is ceased. Therefore, the developing cartridge moved from the mounting and demounting position by the rotation of the rotary 1 is locked with the rotary 1. When the next developing cartridge reaches the mounting and demounting position by the further rotation of the rotary 1, the rotatable engagement-release member 20R, 20R rotates to the developing cartridge releasing position. By doing so, the rotatable engagement-release member 20L, 20R urges the releasing slidable member locking the next developing cartridge with the rotary 1. This enables dismounting of the developing cartridge from the rotary 1. The same applies to the subsequent developing cartridges.

In the case that each of the developing cartridges is provided with detecting means (unshown) for detecting the remaining amount of the toner, the control circuit portion 200 may control the apparatus such that the rotary 1 is stopped in the state that the developing cartridge short of the toner is at the mounting and demounting position. In addition, the control circuit portion 200 may control the apparatus such that the display portion 400*a* displays the lifetime forenotice or the lifetime warning. By doing so, the user can immediately access the developing cartridge to replace by opening the mounting and demounting cover 13.

(Mounted Package)

FIG. 33 is a schematic sectional view showing an image forming apparatus in the mounted packing state. The mounted packing is the packing upon shipping in the state that the developing cartridges 5*a*, 5*b*, 5*c*, 5*d* are mounted in the main assembly of the apparatus 100A. In this embodiment, the four color developing cartridges 5*a*, 5*b*, 5*c*, 5*d* are mounted on the rotary 1 when the apparatus is shipped.

In mounted packing state, as shown in FIG. 33, each developing cartridge 5*a*, 5*b*, 5*c*, 5*d* is mounted to the rotary 1 in the state that the covering member 62 (62*a*, 62*b*, 62*c*, 62*d*) is mounted thereto.

Therefore, in such a case, the user is required to carry out initial installation into the state capable of image formation. More particularly, in the state that the covering member 62 is mounted, the developing cartridges 5*a*, 5*b*, 5*c* and 5*d* mounted to the rotary 1 is once taken out of the main assembly of the apparatus 100A. The developing cartridge is taken out in the same manner as with the case of the removal of the developing cartridge to replace in the above-described developing cartridge exchanging type apparatus. Then, the toner seal 59 of the developing cartridge is removed, and a development covering member 62 is removed, too. Thereafter, the developing cartridge is remounted to the predetermined mounting portion of the rotary 1. The mounting of the developing cartridge is carried out in the same manner as with the case of mounting the developing cartridge in the above-described developing cartridge exchanging type apparatus.

In this embodiment, the yellow developing cartridge 5*a* is at the mounting and demounting position in the mounted packing state. FIG. 34 is a sectional view showing the state in which the mounting and demounting cover 13 is opened from the state of FIG. 33. FIG. 35 is a partial enlarged view of FIG. 34. Yellow developing cartridge 5*a* situated at the mounting and demounting position is released from the rotary 1 by the opening of the mounting and demounting cover 13 so that it becomes removable.

When the user sees the yellow developing cartridge 5*a* through the opening P, the user observes the covering member 62*a* at a position upstream of the developing roller 51*a* with respect to a mounting direction L. Therefore, there is a liability that the user takes out only the covering member 62*a* not the yellow developing cartridge 5*a* as a whole.

In the case that the covering member 62*a* is dismounted within the main assembly of the apparatus 100A, and the yellow developing cartridge 5*a* is taken out of the main assembly of the apparatus 100, and the toner seal 59 is removed, then the covering member 62*a* is not provided. Therefore, the user is likely to touch the developing roller 51*a*.

FIG. 36 is a front view of a structure for preventing this, in which the yellow developing cartridge 5*a* is mounted to the main assembly of the apparatus 100. A disk 31L which is a part of the rotary 1 is provided with a regulating portion 1*d* as a part of the disk 31L at a position opposing in the direction of an arrow N in the Figure which is a removing direction of the covering member 62*a*. In FIG. 36, the depths R, S, T and U of locking between the covering member 62 and the side member 60, 61 are larger than a distance through which the covering member 62*a* moves until it is contacted to the regulating portion 1*d*, as shown in FIG. 28. Therefore, in the mounting and demounting position, even if an attempt is made to move the covering member 62*a* in the direction of the arrow N in the Figure, the movement is prevented by the regulating portion 1*d* and cannot move, and therefore, it cannot be taken out. For this reason, the user cannot dismount the covering member 62*a* in the mounting and demounting position of the developing cartridge, so that the user's touching the developing roller 51*a* can be prevented.

When the user dismounts the yellow developing cartridge 5*a*, the user grips the grip 54. Even if the user touches the covering member 62*a*, the covering member 62*a* does not disengage from the rotary 1 in the radial direction since the removing direction of the covering member 62*a* is the direction of the arrow N in the Figure. As described hereinbefore the movement in the direction of the arrow N in the Figure is limited by the regulating portion 1*d*, and therefore, it is not dislodged. For this reason, even if the user grips the grip 54, the covering member 62*a* is not disengaged, and therefore, the touching to the developing roller 51*a* can be prevented. In addition, the covering member 62*a* is not disengaged even by the vibration during the transportation of the main assembly of the apparatus 100A or by the centrifugal force during the rotation of the rotary 1.

In this embodiment, the regulating portion 1*d* is provided as a part of the disk 31L, but this is not inevitable, and it may be provided on a part of a structure of the main assembly of the apparatus 100 other than the disk 31L.

As shown in FIG. 38, by the user gripping the grip 54 and moving it in the direction of an arrow K in the Figure, the user can takes the yellow developing cartridge 5*a* out of the main assembly of the apparatus 100. Here, the direction of the arrow K is a direction perpendicular (crossing) to the axis of the developing roller 51*a*. From the yellow developing cartridge 5*a*, the user first removes the toner seal 59 shown in FIG. 27. Then, the covering member 62*a* is dismounted. The yellow developing cartridge 5*a* is inserted into the main assembly of the apparatus 100 to be mounted to the rotary 1.

Referring to FIGS. 25 and 37, the structure realizing such an operation will be described in detail. As a result of dismounting of the yellow developing cartridge 5*a*, the covering member 62*a* becomes movable in the direction of the arrow N in the Figure. Before the covering member 62*a* is removed, the toner seal 59 shown in FIG. 27 is first removed from the yellow developing cartridge 5*a*. Then, the covering member 62*a* is moved in the direction of an arrow N in FIGS. 25 and 37 and is dismounted. The yellow developing cartridge 5*a* not having the covering member 62*a* is moved in the direction of an arrow L shown in FIG. 39 by the grip 54, by which the yellow developing cartridge 5*a* is mounted to the rotary 1 again. Here, the direction of the arrow L is a direction perpendicular (crossing) to the axis of the developing roller 51*a*.

These operations are repeated for the developing cartridges 5*a*, 5*b*, 5*c*, 5*d* by which the initial installation of the main assembly of the apparatus 100 is completed.

Structure of the image forming apparatus of the embodiment is summarized as follows. The developing cartridge 5 comprises at least a developing roller 51 as a developer carrying member, a frame 64 for supporting the developing roller 51, a covering member 62 for covering an exposed portion 51*e* of the developing roller 51 from the frame 64. The covering member 62 is demountably in the direction of an axial direction of the developing roller 51 relative to the frame 64. The developing cartridge 5 is mountable and dismountable retroactive to the main assembly of the apparatus 100A of the image forming apparatus 100 through an opening P provided in the main assembly of the apparatus 100A in the direction perpendicular (crossing with) to an axial direction of the developing roller 51. The covering member 62 is disposed upstream of the developing roller 51 with respect to a mounting direction L of the developing cartridge 5 to the main assembly of the apparatus 100A. The main assembly of the apparatus 100A includes a regulating portion 1*d* for regulating movement of the covering member 62 in the axial direction of the developing roller 51 in the state that the developing cartridge 5 having the covering member 62 mounted thereto is mounted to the main assembly of the apparatus 100A. The developing cartridge 5 is provided with a grip portion 54.

The structure of the developing cartridge 5 of the embodiment is summarized as follows. It comprises at least a developing roller 51 which is a developer carrying member, and a frame 64 supporting the developing roller 51, wherein it is mountable and dismountable retroactive to the main assembly 100A of the image forming apparatus 100 in the direction perpendicular to an axial direction of the developing roller 51. The developing cartridge 5 comprises a covering member 62 which covers an exposed portion 51*e* of the developing roller 51 exposed from the frame 64 And which is demountable in the axial direction of the developing roller 51 relative to the frame 64, and a grip portion 54 provided exposed from the covering member 62. The covering member 62 is disposed upstream of the developing roller 51 with respect to the mounting direction L of the developing cartridge 5 relative to the main assembly of the apparatus 100A. The covering member 62 is limited by the regulating portion 1*d* provided in the main assembly of the apparatus 100A in the movement in the axial direction of the developing roller 51 in the state that the developing cartridge 5 is mounted to the main assembly of the apparatus 100A.

According to the image forming apparatus and the developing cartridge, the disengagement of the covering member 62 is prevented in the initial installing operation of the image forming apparatus so that the developing roller 51 can be assuredly protected. By the operation of gripping the grip portion 54, the disengagement of the covering member 62 is prevented so that the assured protection of the developing roller 51 is accomplished.

As described in the foregoing, the disengagement of the covering member 62 is prevented, and the protection of the developing roller 51 can be assuredly accomplished.

When the developing cartridge which is short of the toner is exchanged, the user grips the grip 54 exposed from the covering member 62 of the new developing cartridge. At this time, as described hereinbefore, the removing direction of the covering member 62 is limited to the direction of the arrow N in the Figure, and therefore, the covering member 62 is not disengaged by the griping operation of the grip 54. Thereafter, the toner seal is removed, and as shown in FIG. 25, the covering member 62 is dismounted by moving it in the direction of the arrow N in the Figure. As shown in FIG. 39, the user grips the grip 54 are mounts it to the main assembly of the apparatus 100A the mounting and demounting cover 13 of which is open by moving it in the direction of the arrow L in the Figure.

As described in the foregoing, the developing cartridge is provide wherein when the user grips the grip, the disengagement of the covering member is prevented, so that the developing roller is assuredly protected.

The developing cartridge is not limited to the examples described above, and it may comprise at least the developing roller for developing the latent image on the photosensitive drum.

In the foregoing, the description has been made with respect to an exemplified electrophotographic image forming apparatus, but the present invention is applicable to an electrostatic recording type image forming apparatus or a magnetic recording type image forming apparatus with the similar advantageous effects.

According to the image forming apparatus and the developing cartridge of the present invention, the disengagement of the covering member is prevented so that the developer carrying member can be protected assuredly. In addition, by the gripping of the grip portion, disengagement of the covering member is prevented, so that the developer carrying member can be protected assuredly.

These and other objects, features and advantages of the present invention will become more apparent upon a consideration of the following description of the preferred embodiments of the present invention taken in conjunction with the accompanying drawings.

Figure 1:
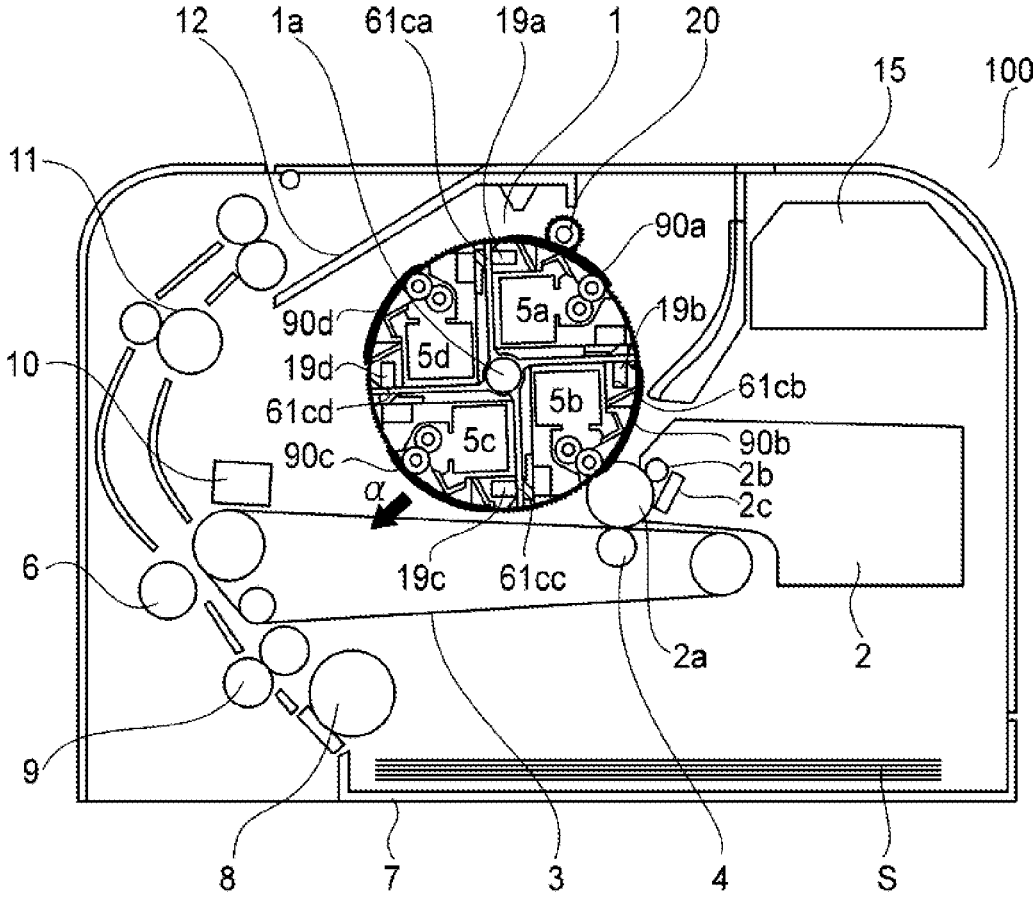
FIG. 1 is a schematic sectional view of an image forming apparatus in the state that a developing cartridge having a developing roller protecting member is mounted in a main assembly of the image forming apparatus, in which state the image forming apparatus is shipped.
Figure 2:
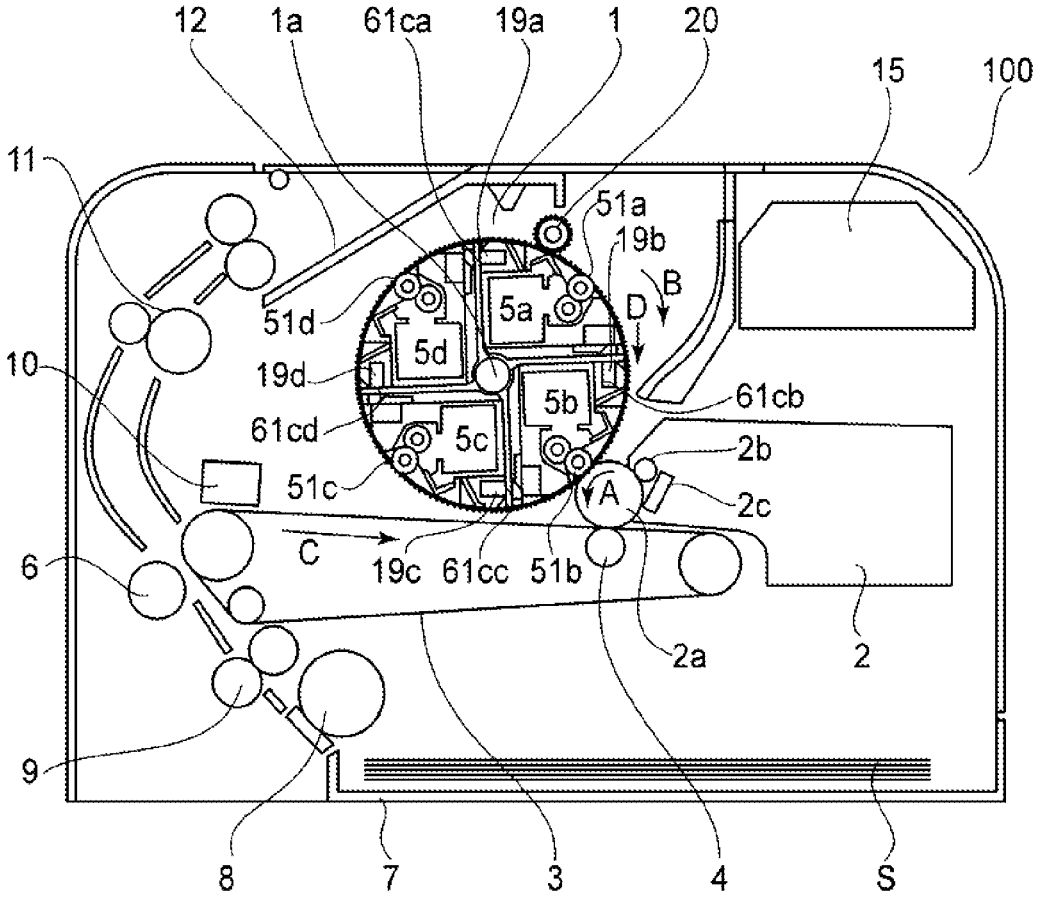
FIG. 2 is a schematic sectional view of the main assembly of the image forming apparatus during developing operation.
Figure 3:
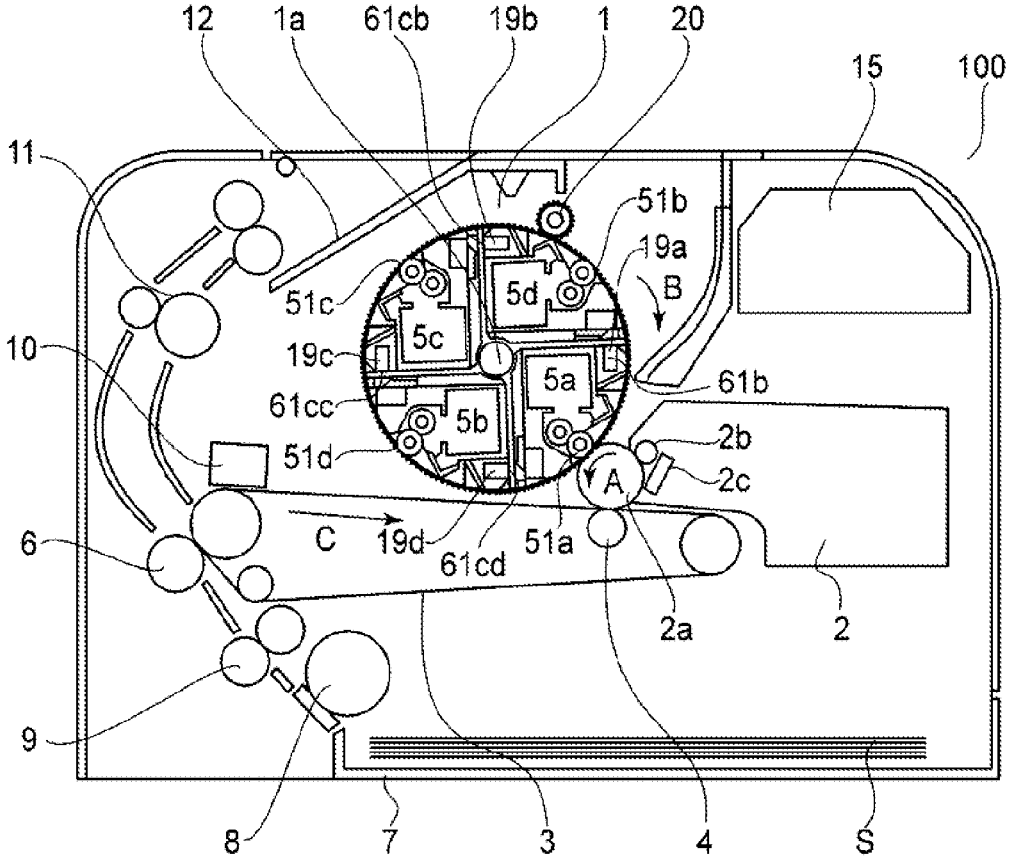
FIG. 3 is a schematic sectional view of the main assembly of the image forming apparatus during developing operation.
Figure 4:
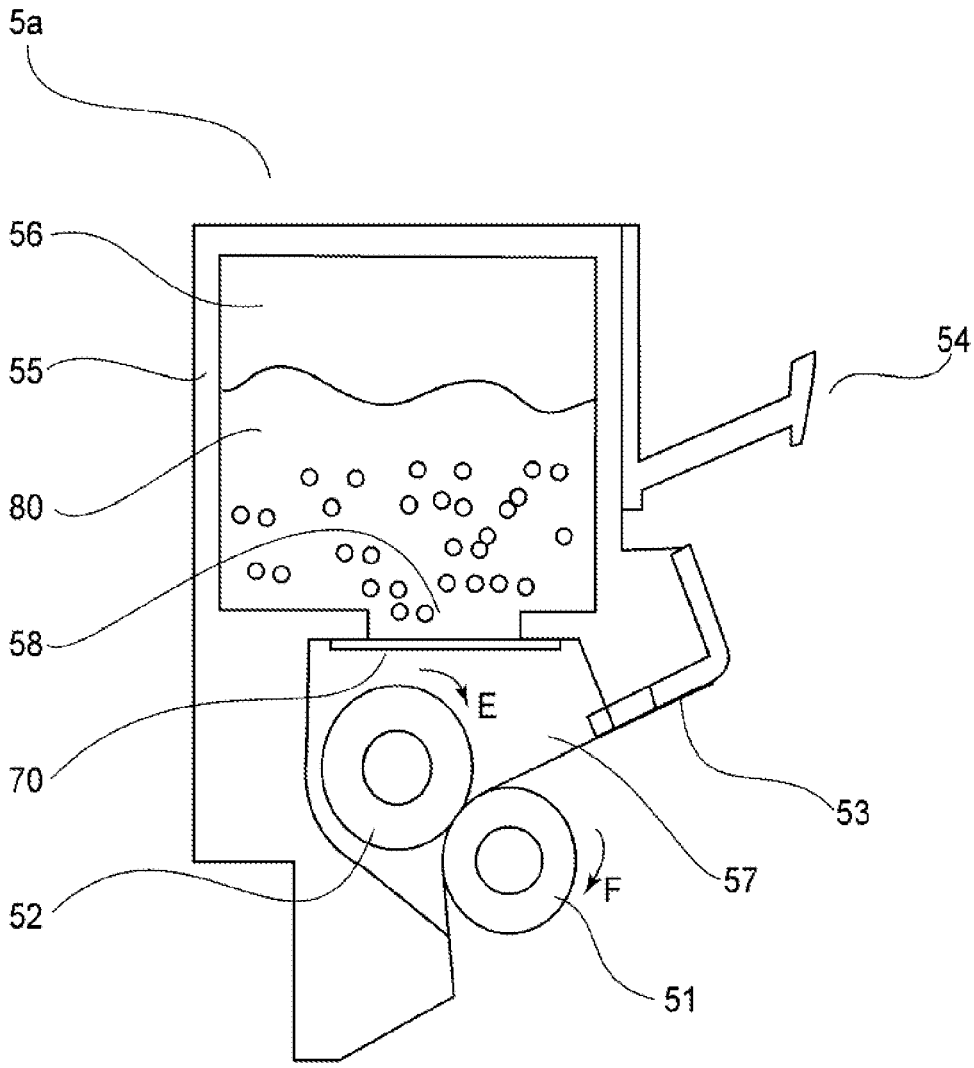
FIG. 4 is a schematic sectional view of the developing cartridge sealed by a developer sealing member.
Figure 5:
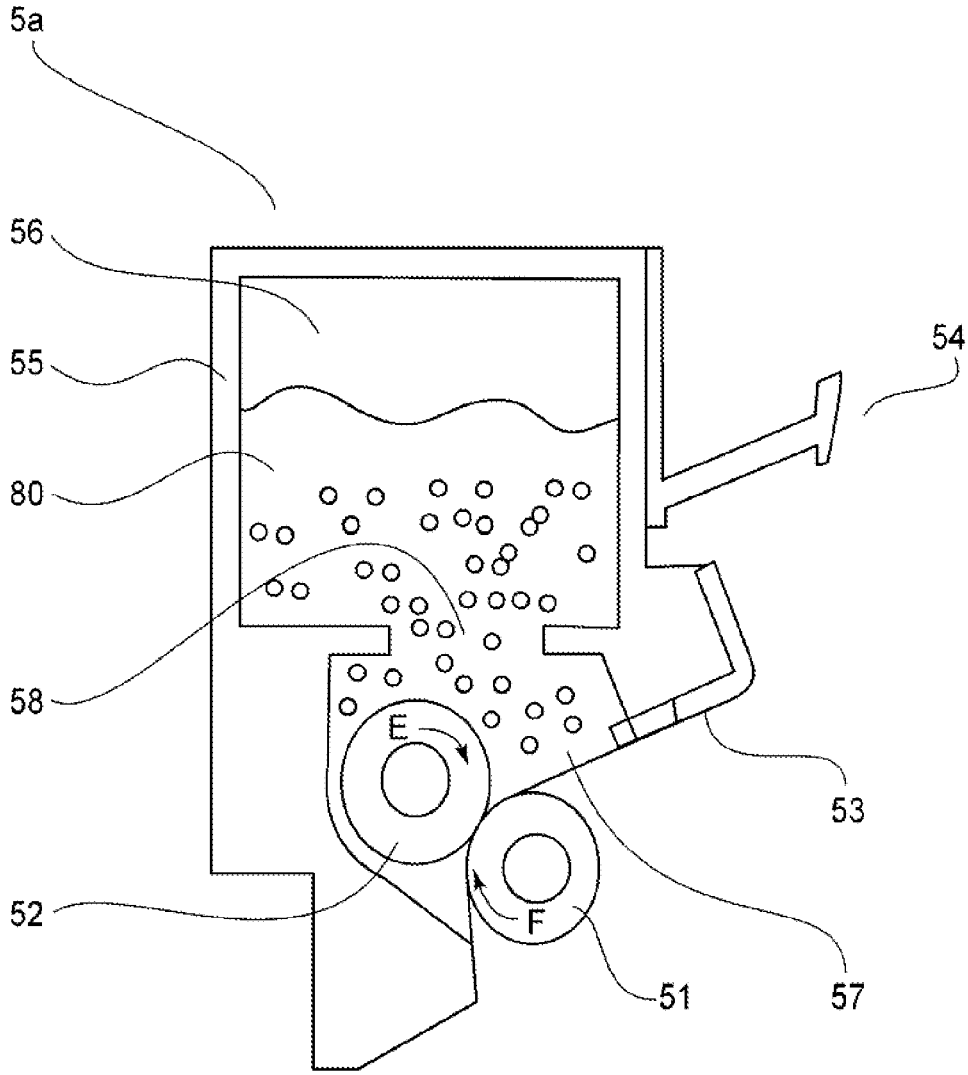
FIG. 5 is a schematic sectional view of the developing cartridge from which the developer sealing member has been removed.
Figure 6:
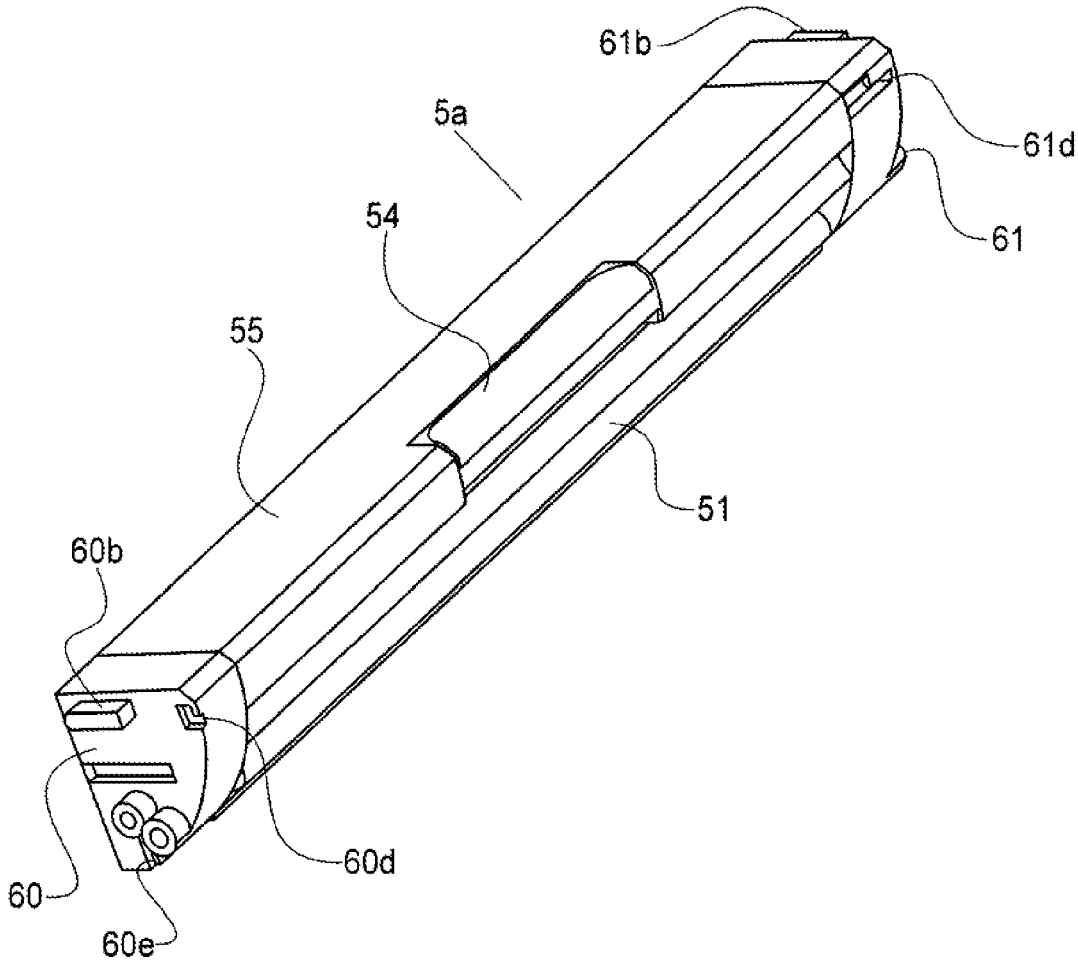
FIG. 6 is a schematic perspective view of the developing cartridge.
Figure 7:
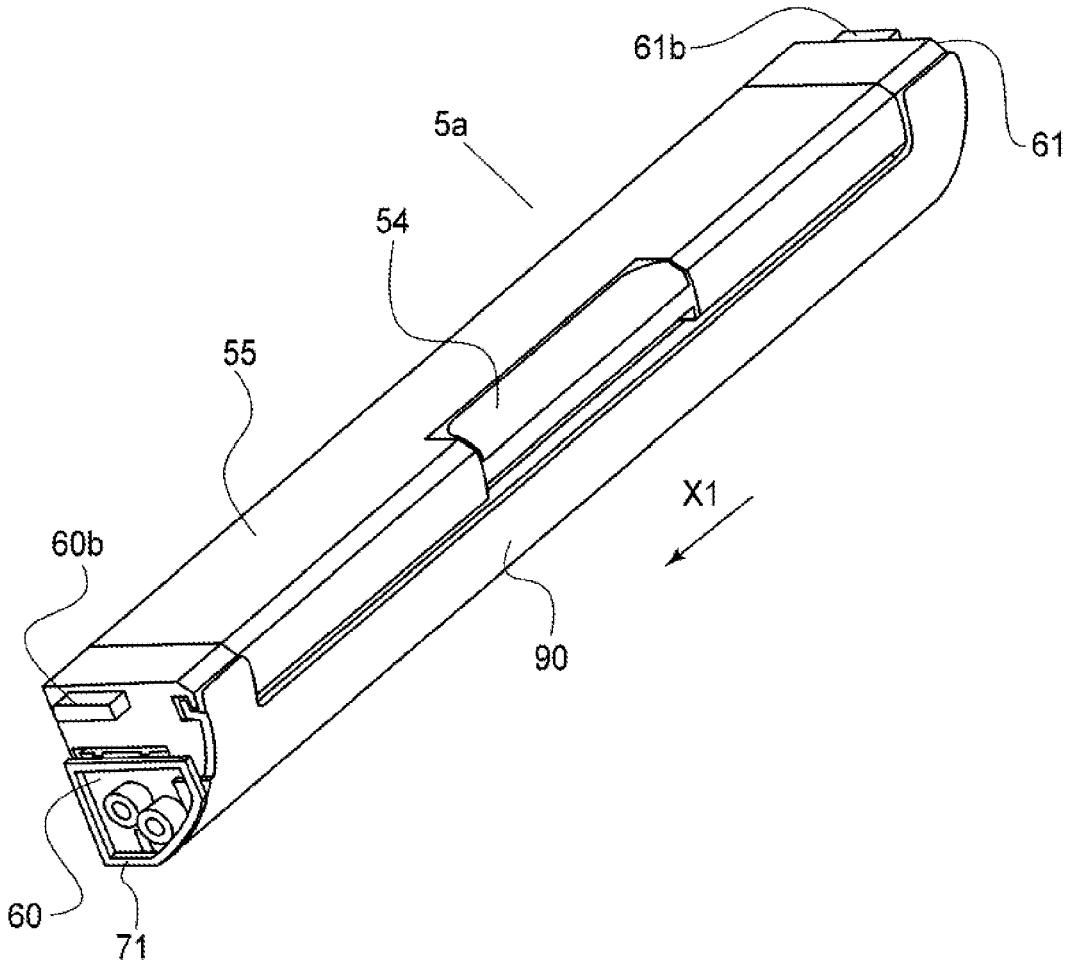
FIG. 7 is a schematic perspective view of the developing cartridge provided with a developing roller protecting member and a grip portion.
Figure 8:
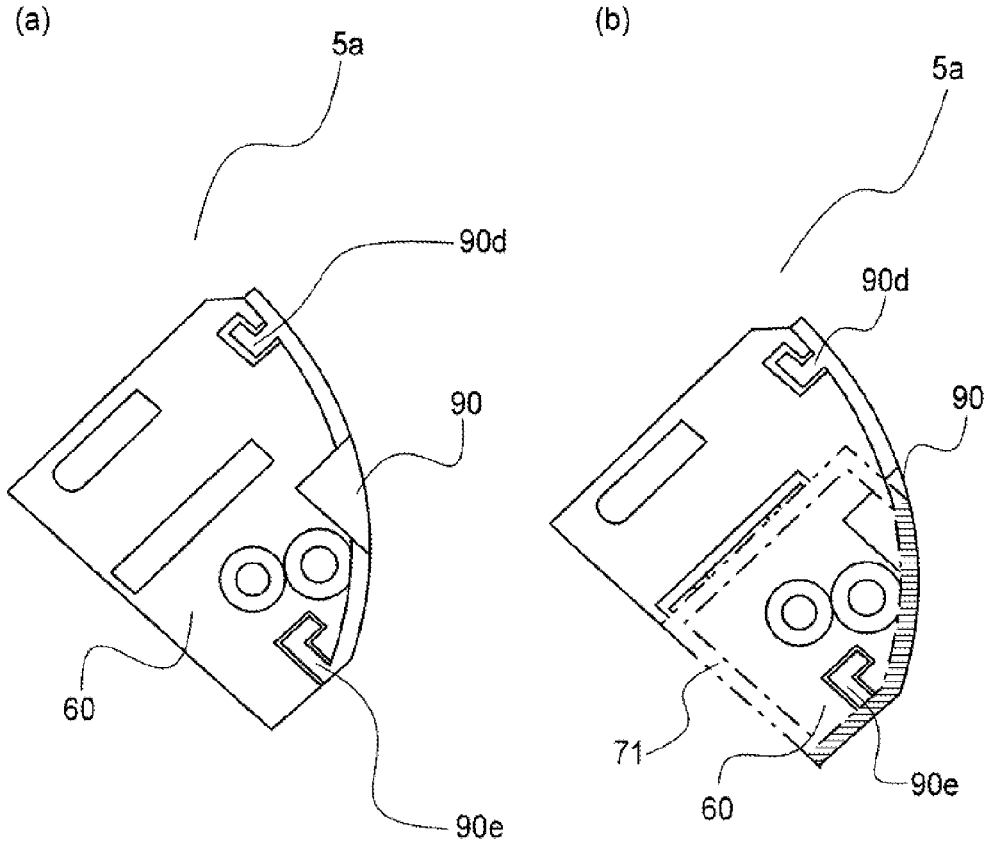
FIG. 8 is a side view showing a positional relation between the developing roller protecting member and the grip portion.
Figure 9:
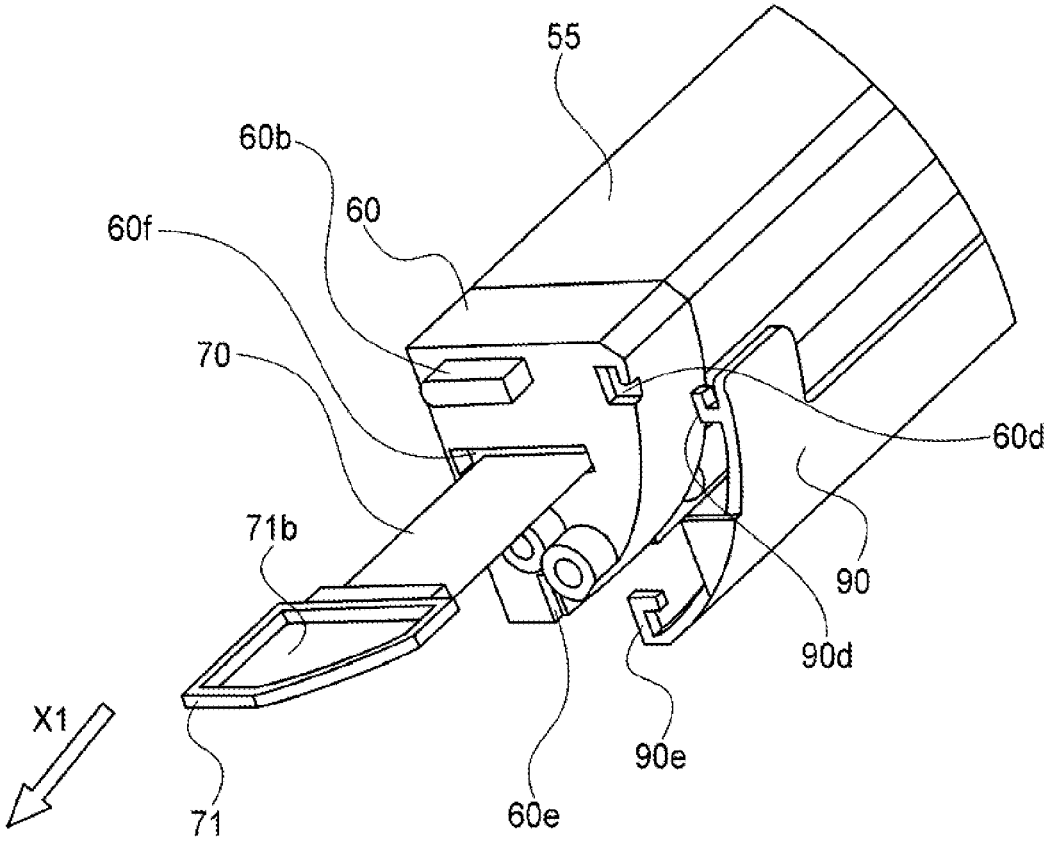
FIG. 9 is a perspective view showing operations of the grip portion and the protecting member of the developing device.
Figure 10:
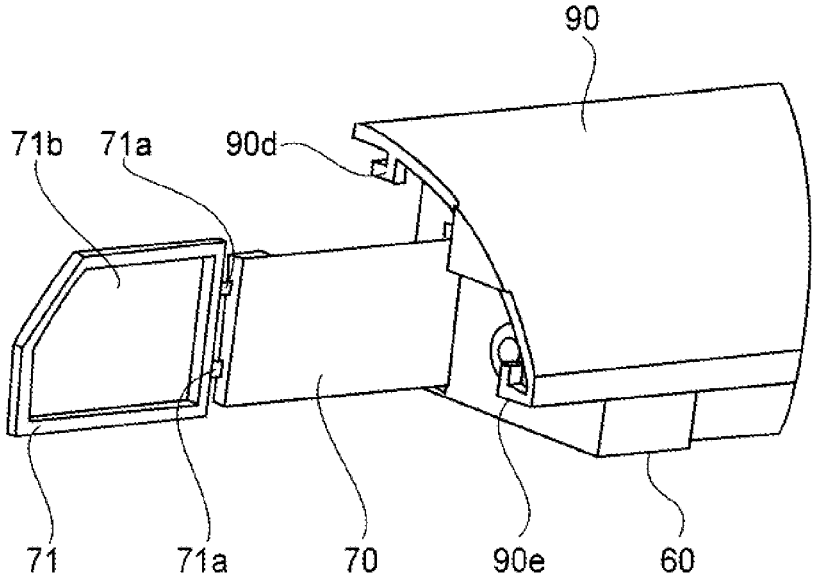
FIG. 10 is an illustration of removal of the developer sealing member.
Figure 11:
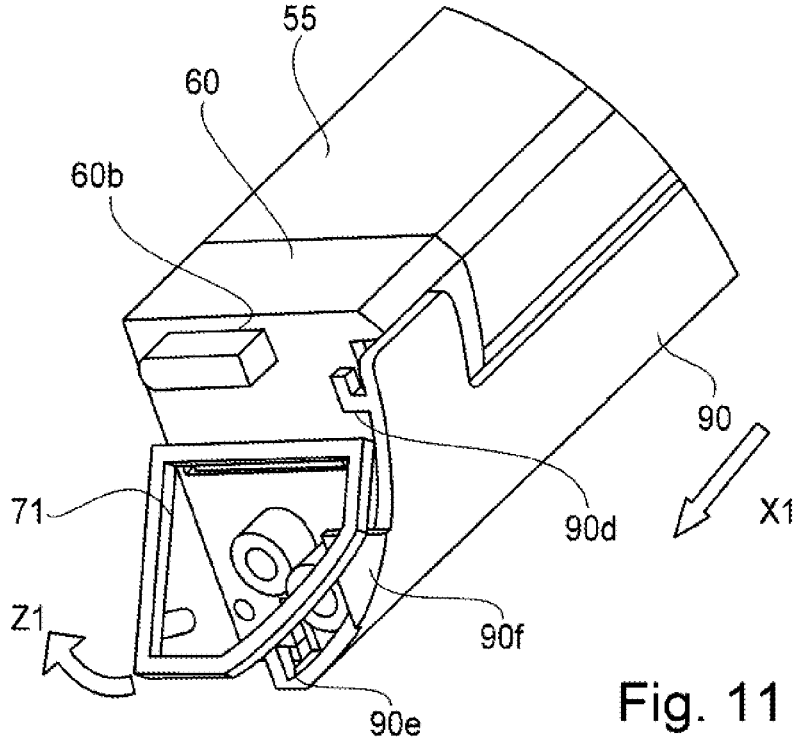
FIG. 11 is a schematic perspective view showing a state in which the grip portion is retracted from a movement locus of the developing roller protecting member.
Figure 12:
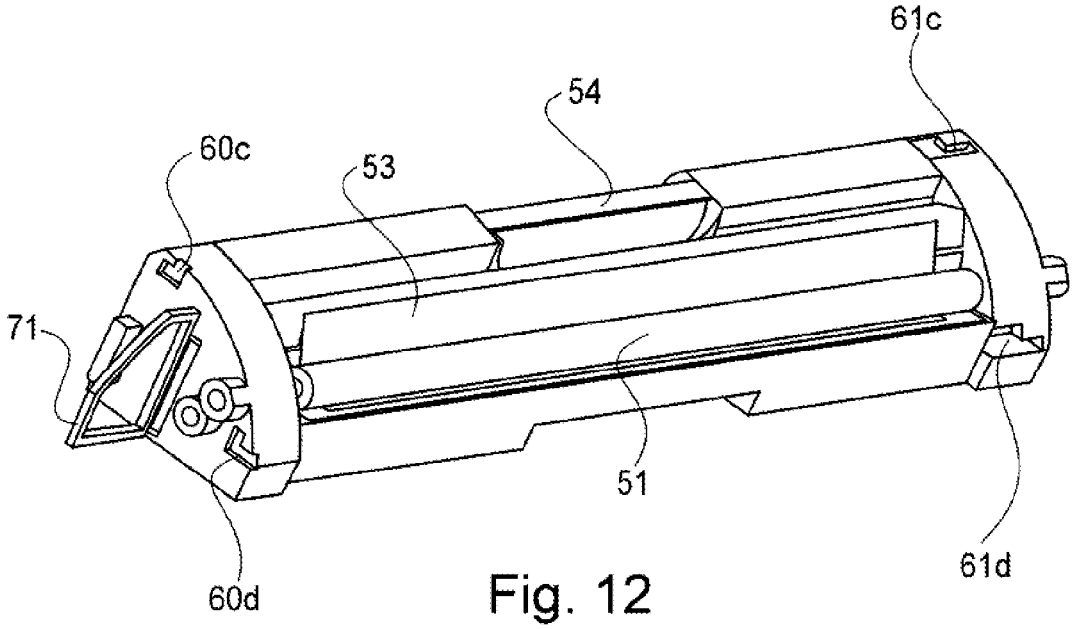
FIG. 12 is a perspective view of the developing cartridge in a state that the grip portion is erected.
Figure 13:
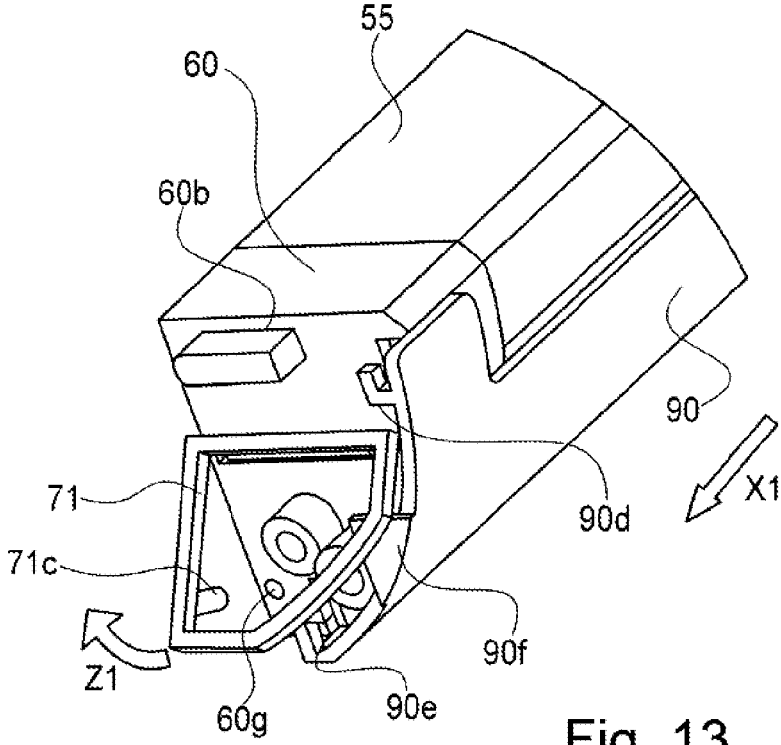
FIG. 13 is a schematic perspective view of the developing cartridge provided with a locking portion for locking the grip portion.
Figure 14:
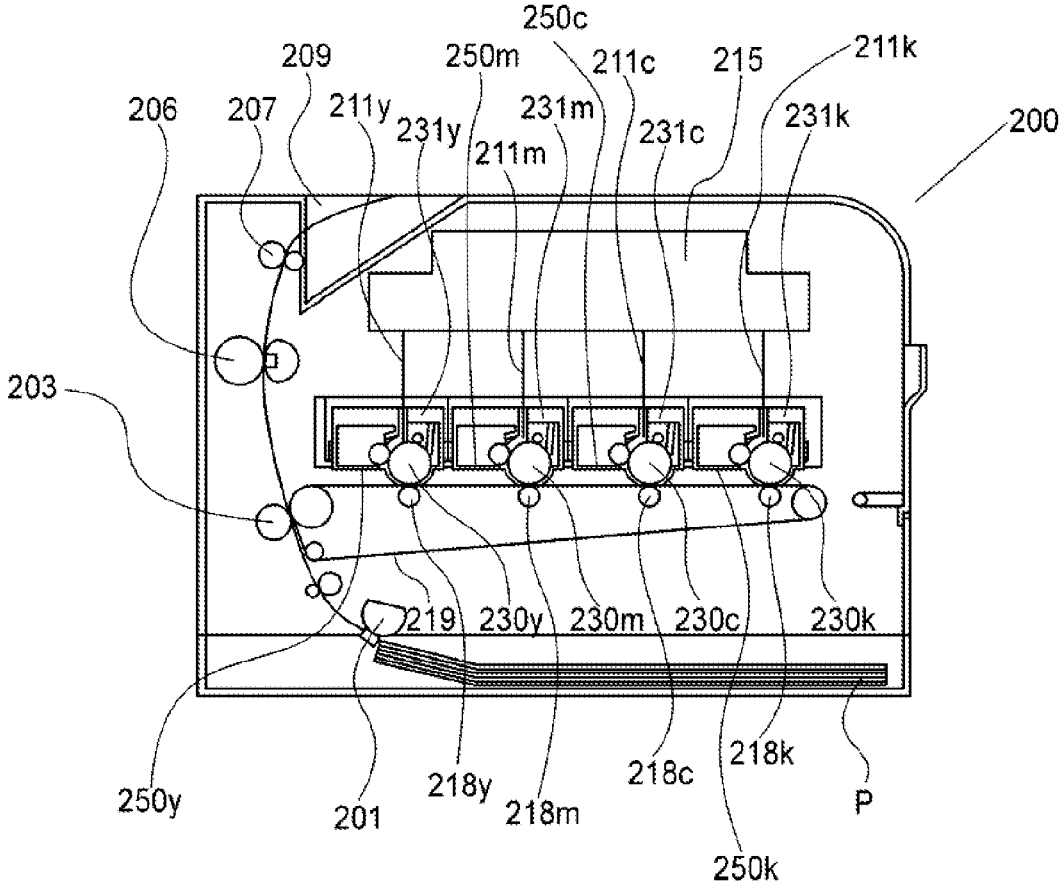
FIG. 14 is a schematic sectional view of the image forming apparatus to which a process cartridge according to a second embodiment is mounted.
Figure 15:
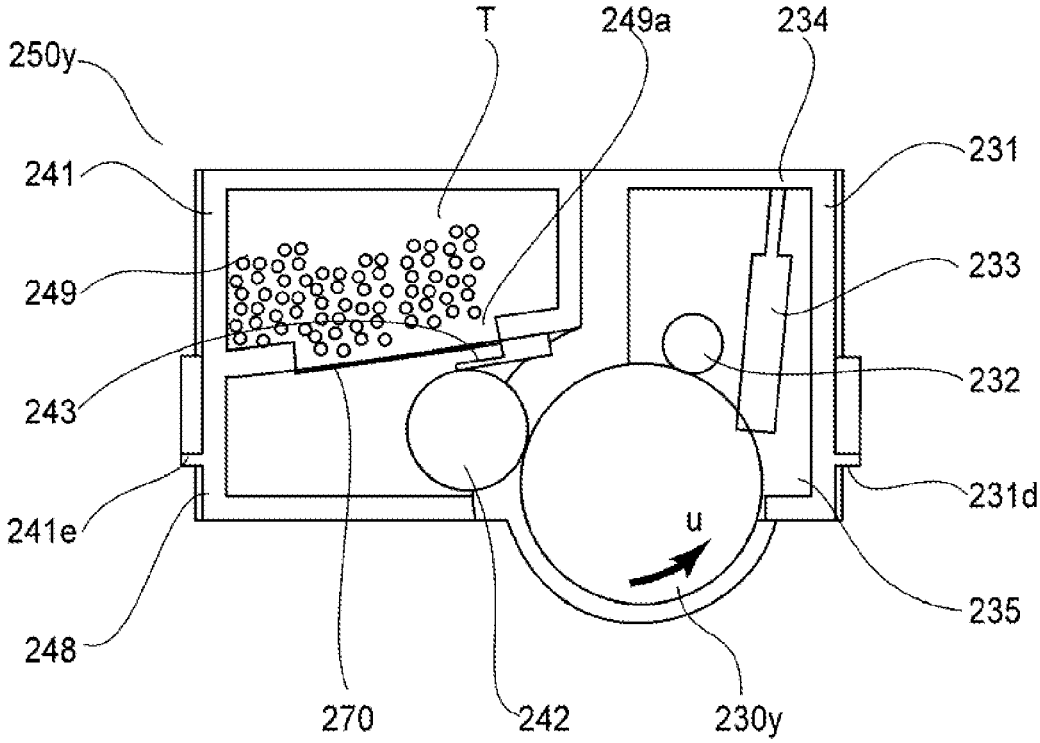
FIG. 15 is a schematic sectional view of the process cartridge of the second embodiment.
Figure 16:
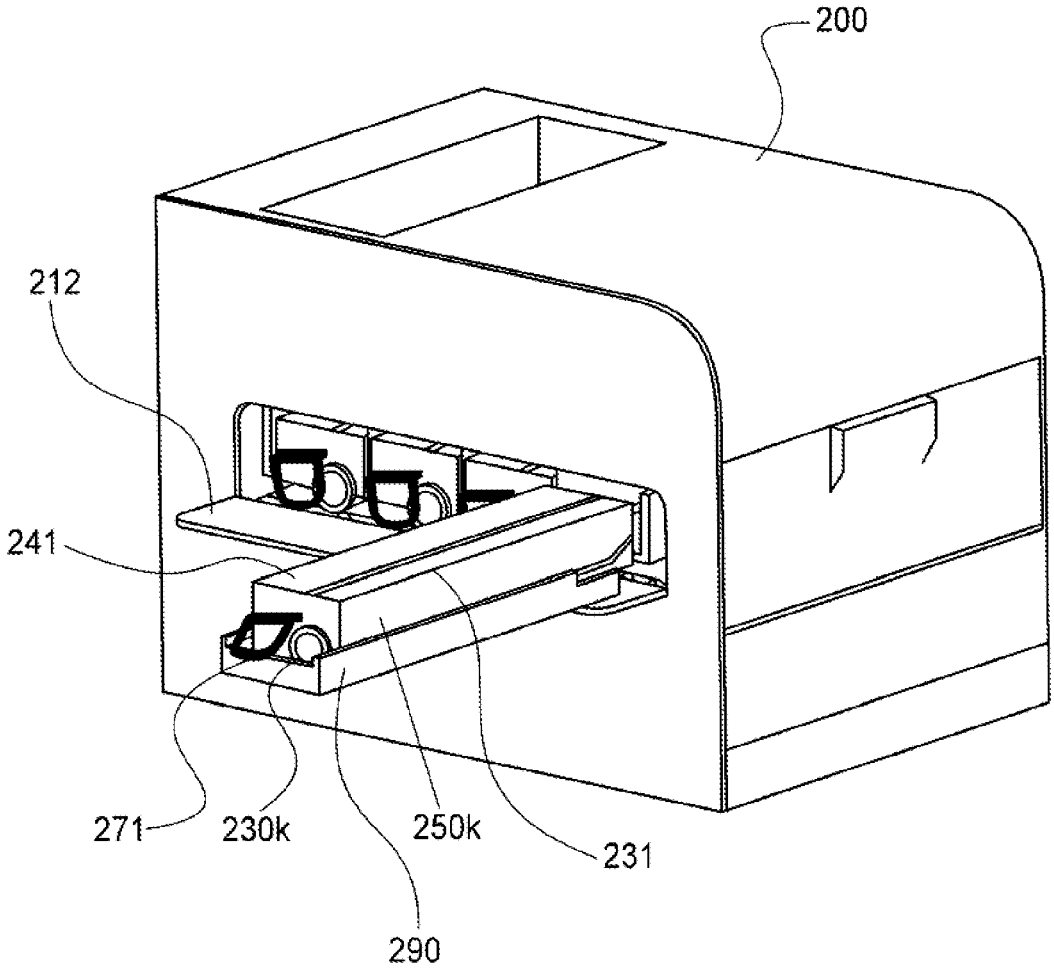
FIG. 16 is an illustration of insertion of the process cartridge of the second embodiment into the main assembly of the image forming apparatus.
Figure 17:
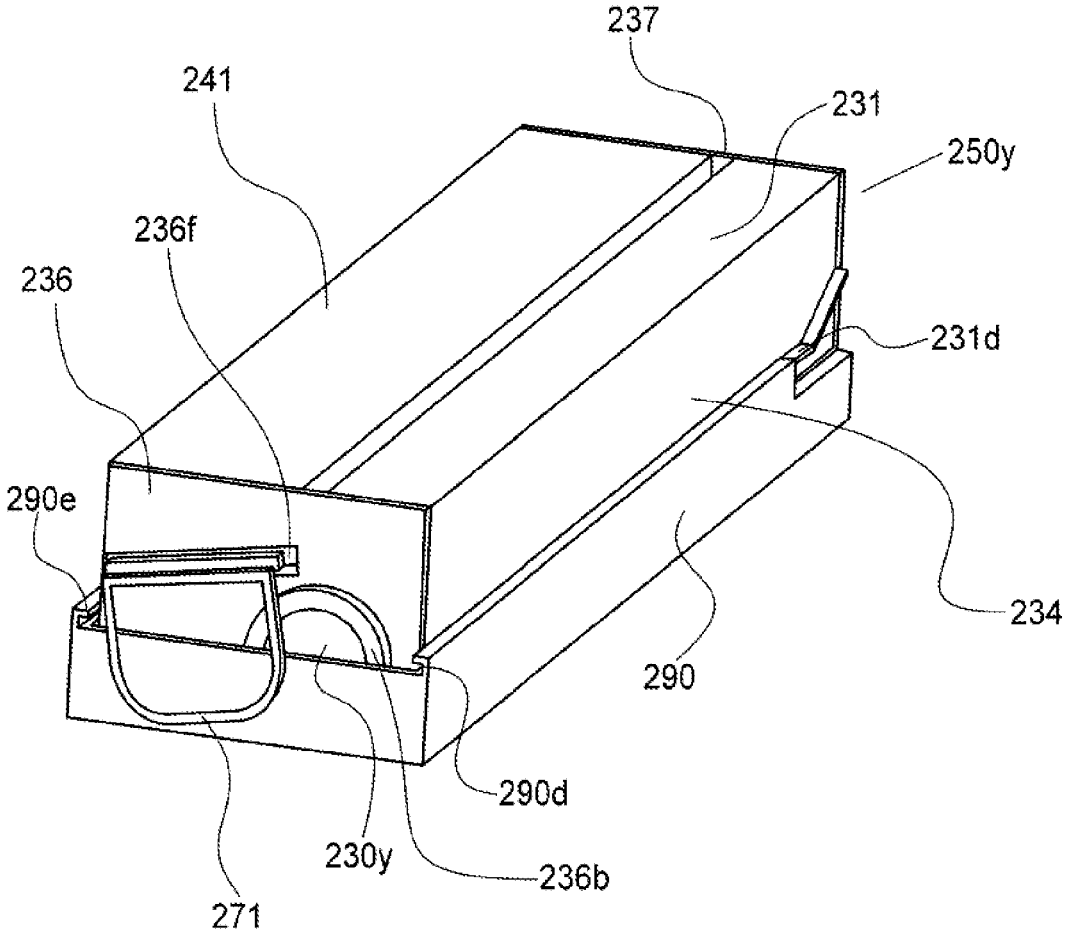
FIG. 17 is a schematic perspective view of the process cartridge of the second embodiment which is provided with a photosensitive drum protecting member.
Figure 18:
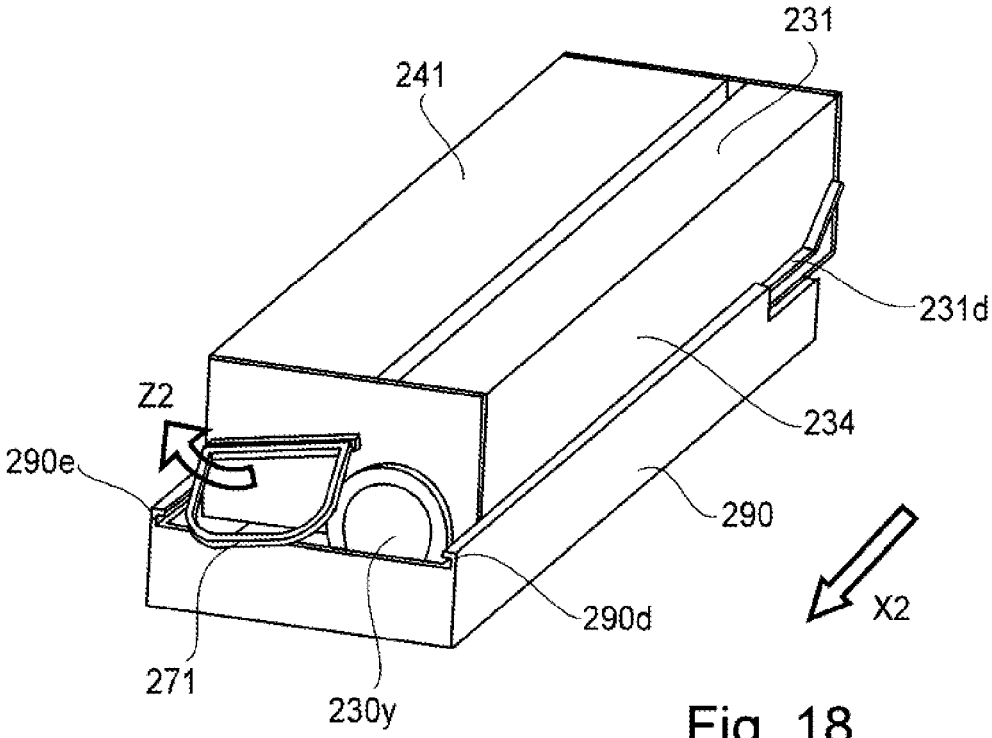
FIG. 18 is a schematic perspective view showing a state in which the grip portion is retracted from the movement locus of the photosensitive drum protecting member, according to the second embodiment.
Figure 19:
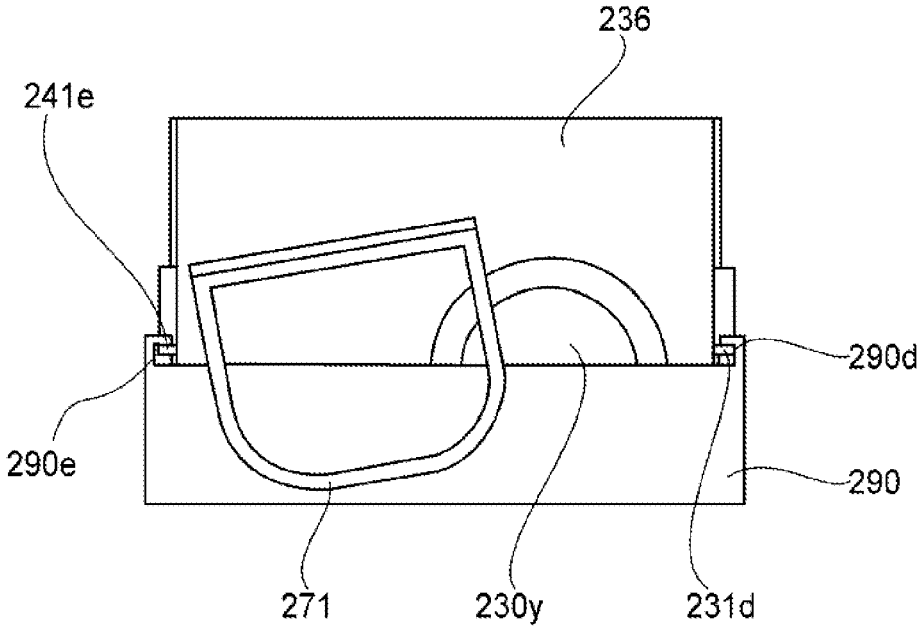
FIG. 19 side view showing a positional relation between the photosensitive drum protecting member and the grip portion, according to the second embodiment.
Figure 20:
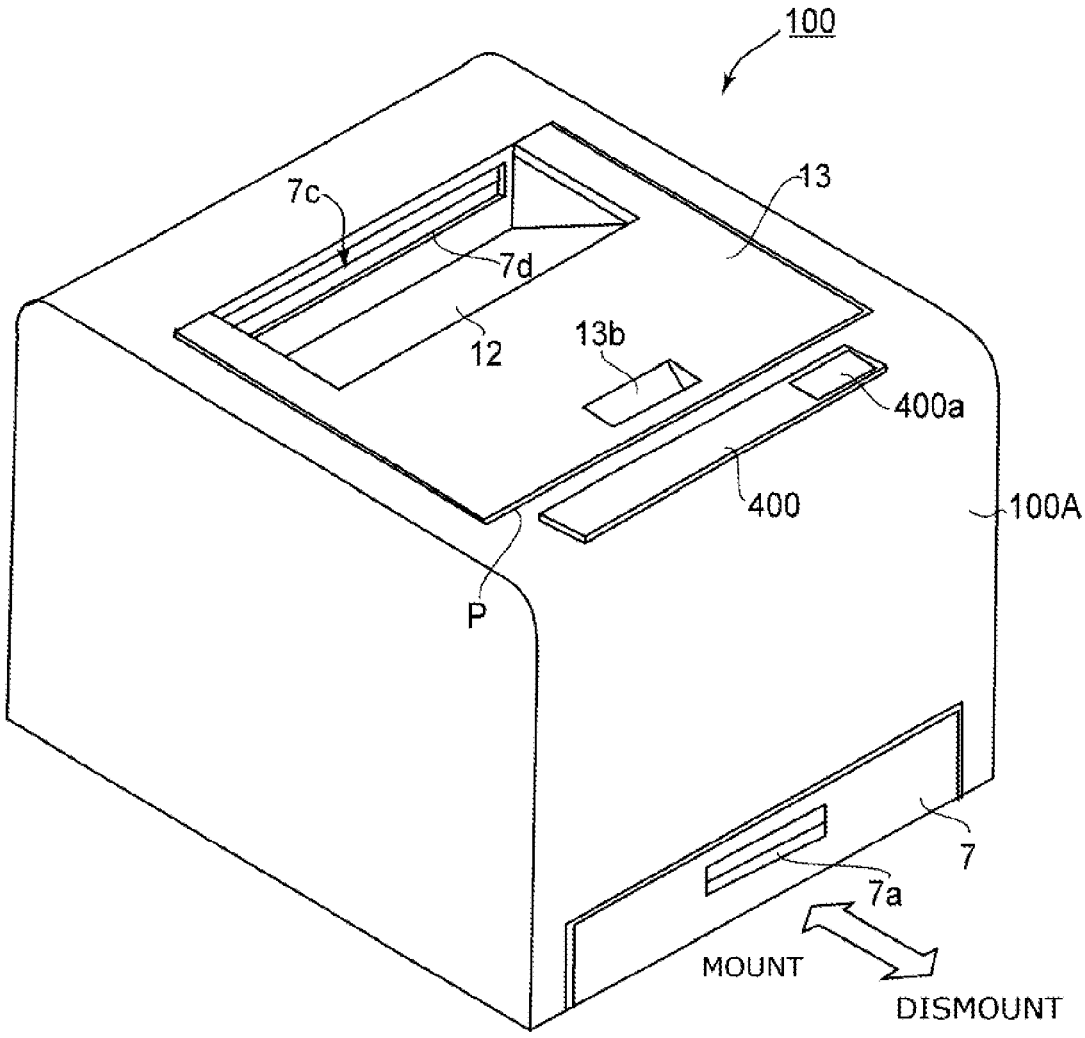
FIG. 20 is a perspective view of an outer appearance of the image forming apparatus of the embodiment.
Figure 21:
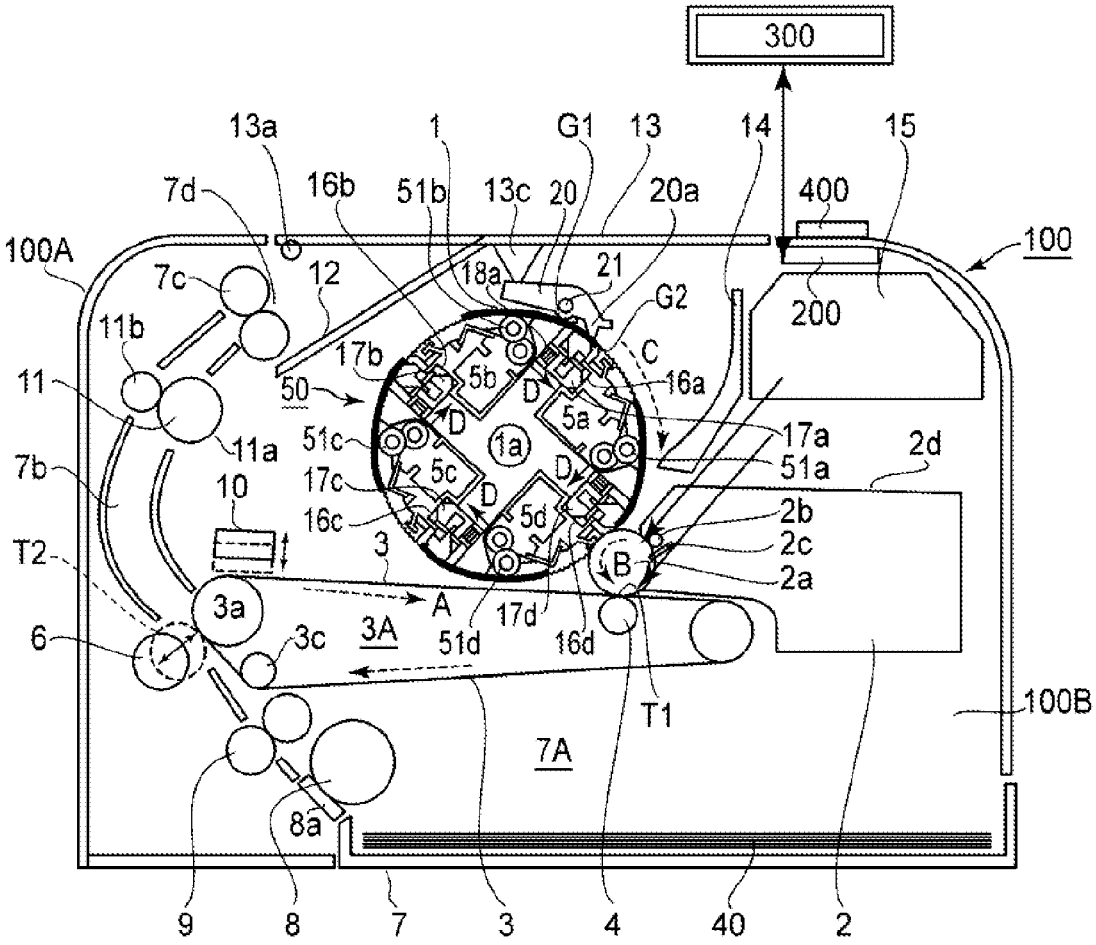
FIG. 21 is a left longitudinal section (stand-by state) of the image forming apparatus of FIG. 20.
Figure 22:
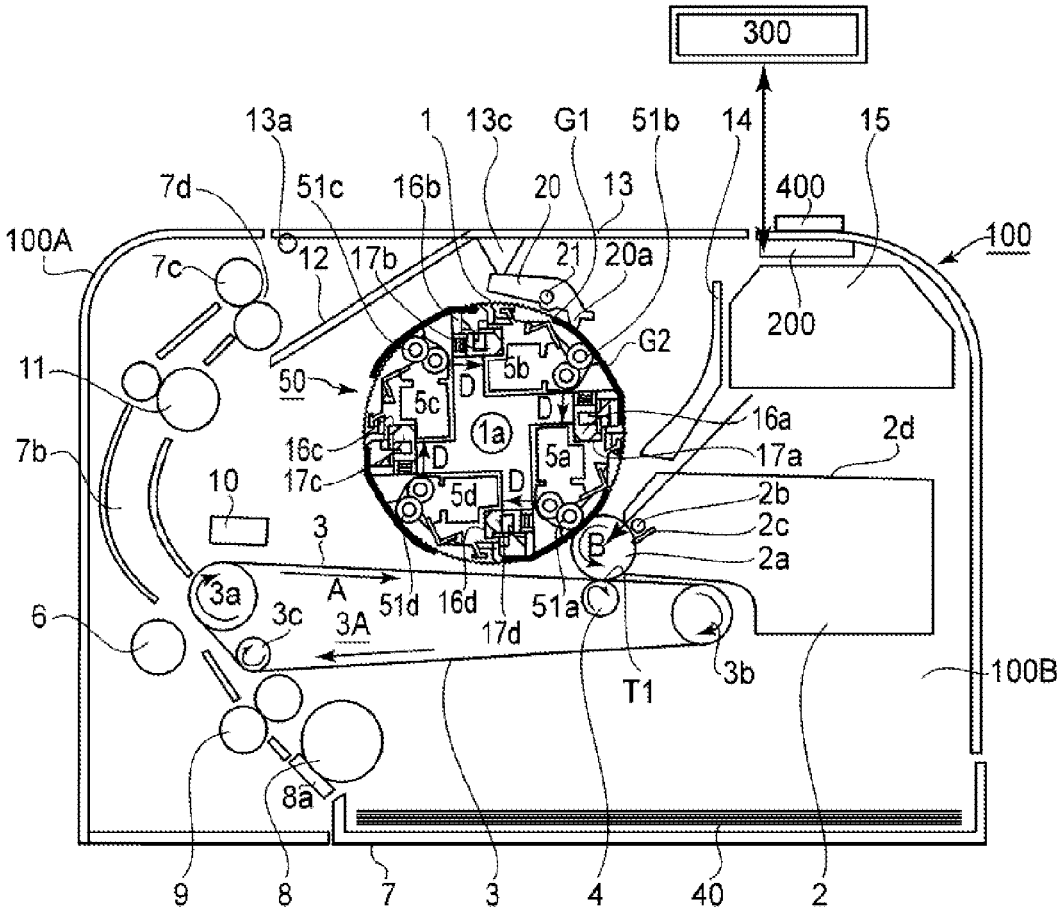
FIG. 22 is a left longitudinal section of the image forming apparatus during developing operation in a yellow developing cartridge.
Figure 23:
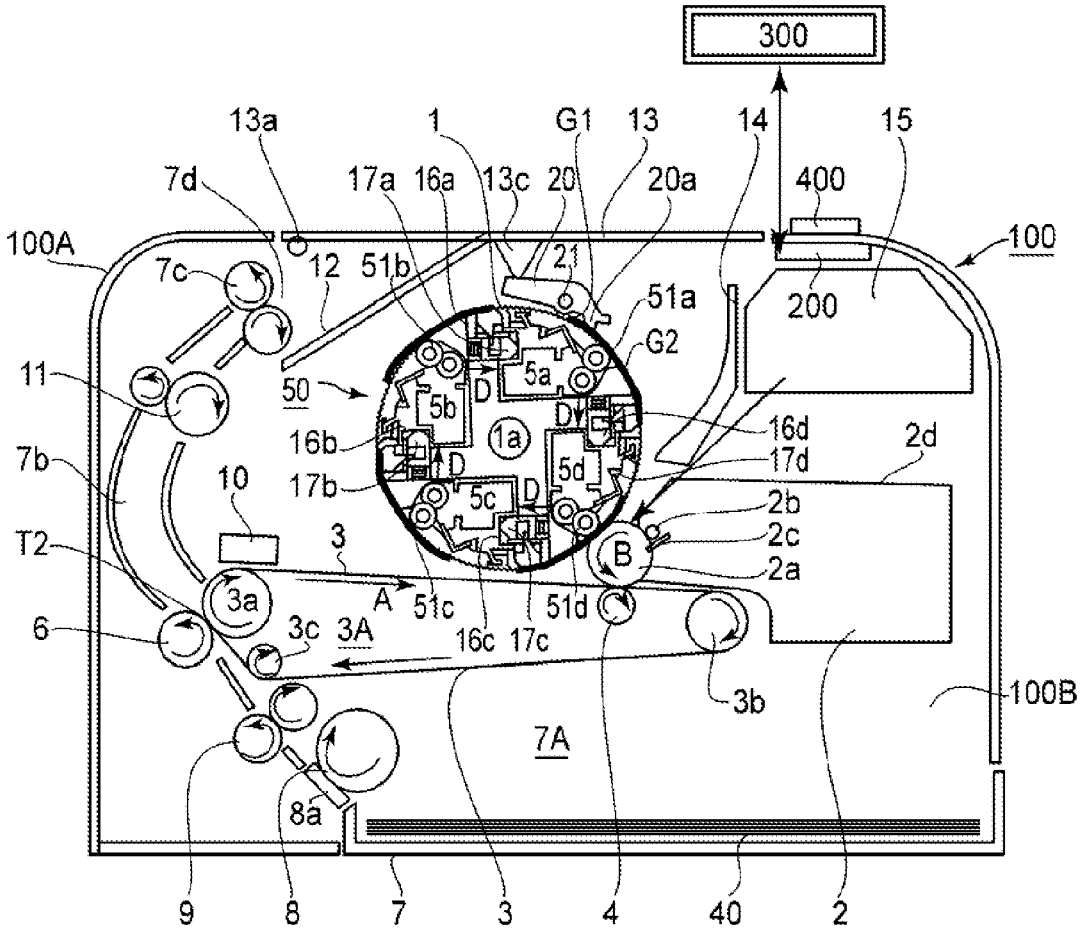
FIG. 23 is a left longitudinal section of the image forming apparatus during the developing operation of a black developing cartridge.
Figure 24:
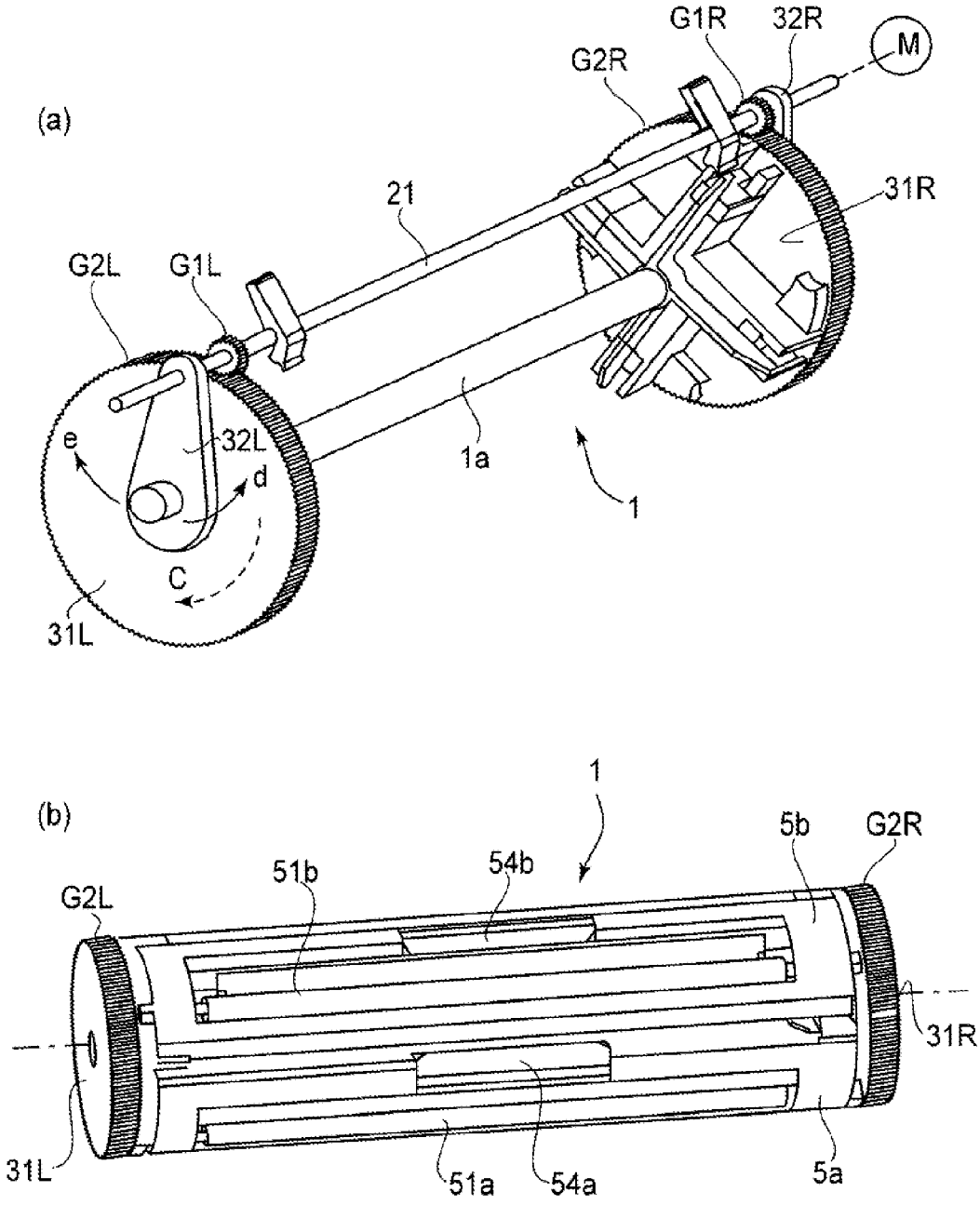
FIG. 24 is an illustration of a rotary.
Figure 25:
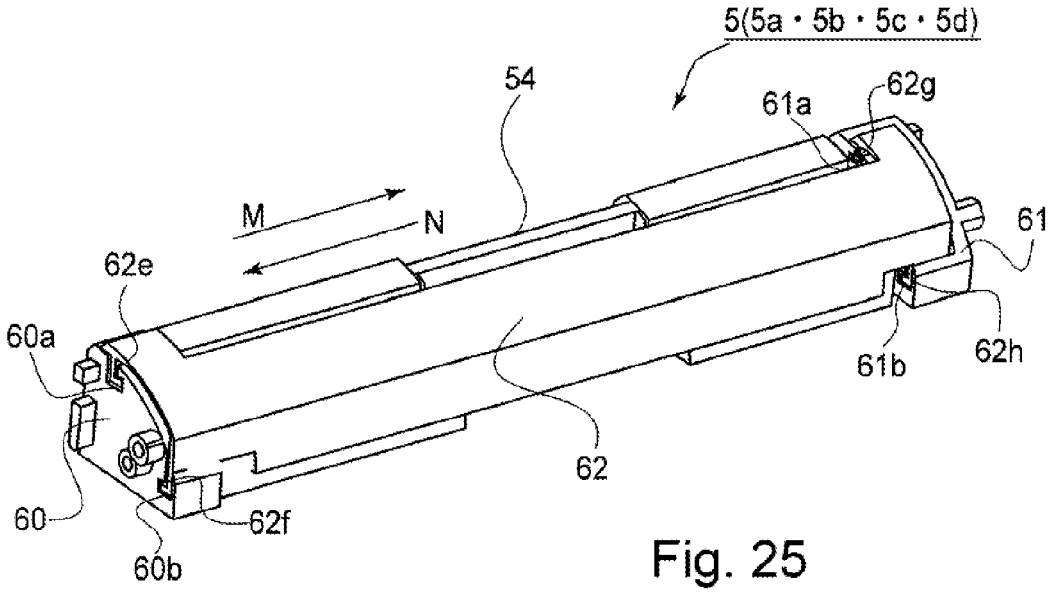
FIG. 25 is a perspective view of the developing cartridge in the state that it is provided with a covering member mounted thereto.
Figure 26:
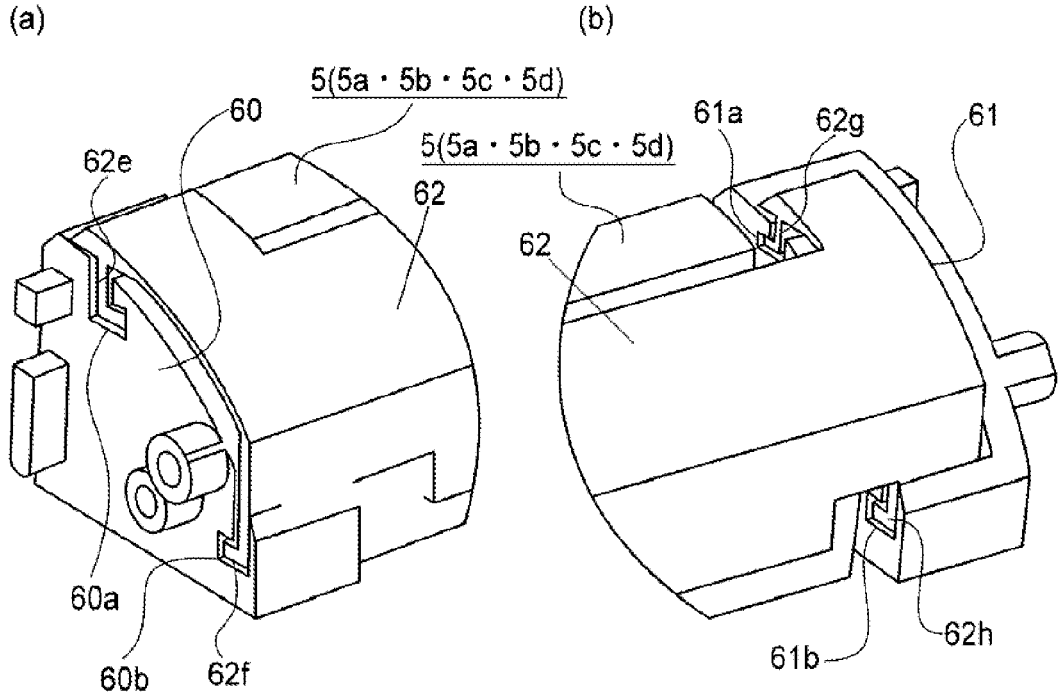

Parts (a) and (b) of FIG. 26 are enlarged views of one longitudinal end portion and the other end portion of the developing cartridge of FIG. 25, respectively.

Figure 27:
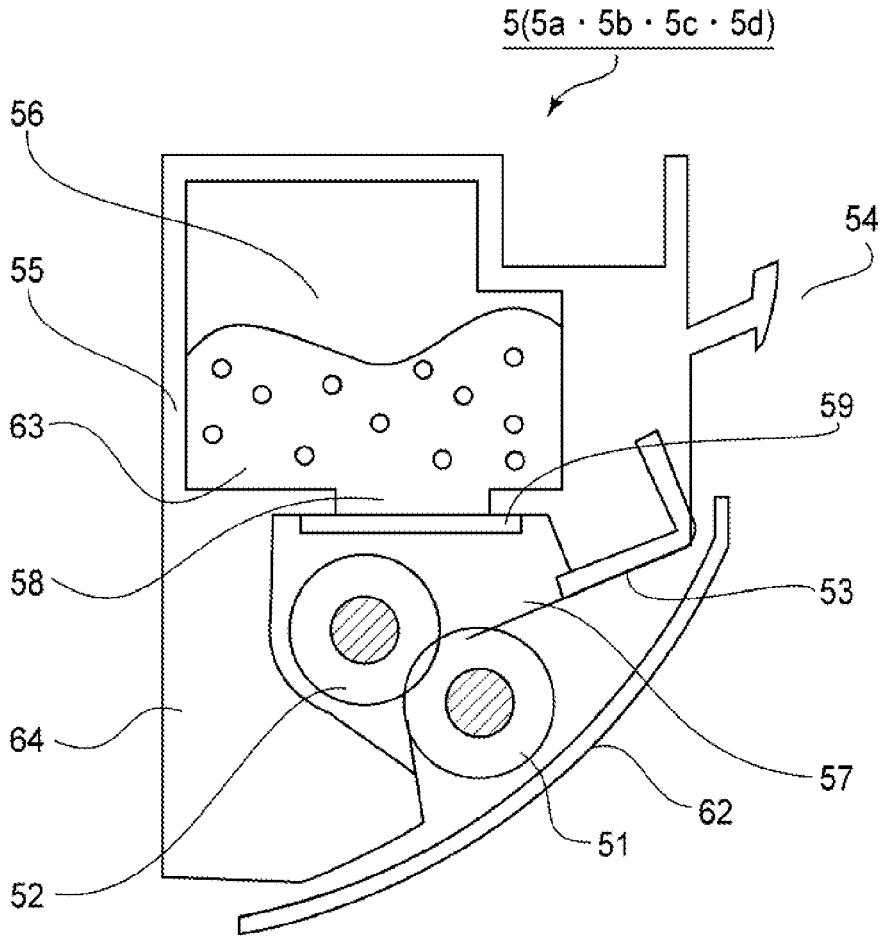

FIG. 27 is an enlarged schematic cross-sectional view of the central portion of the developing cartridge of FIG. 25, with respect to the longitudinal direction, of the developing cartridge.

Figure 28:
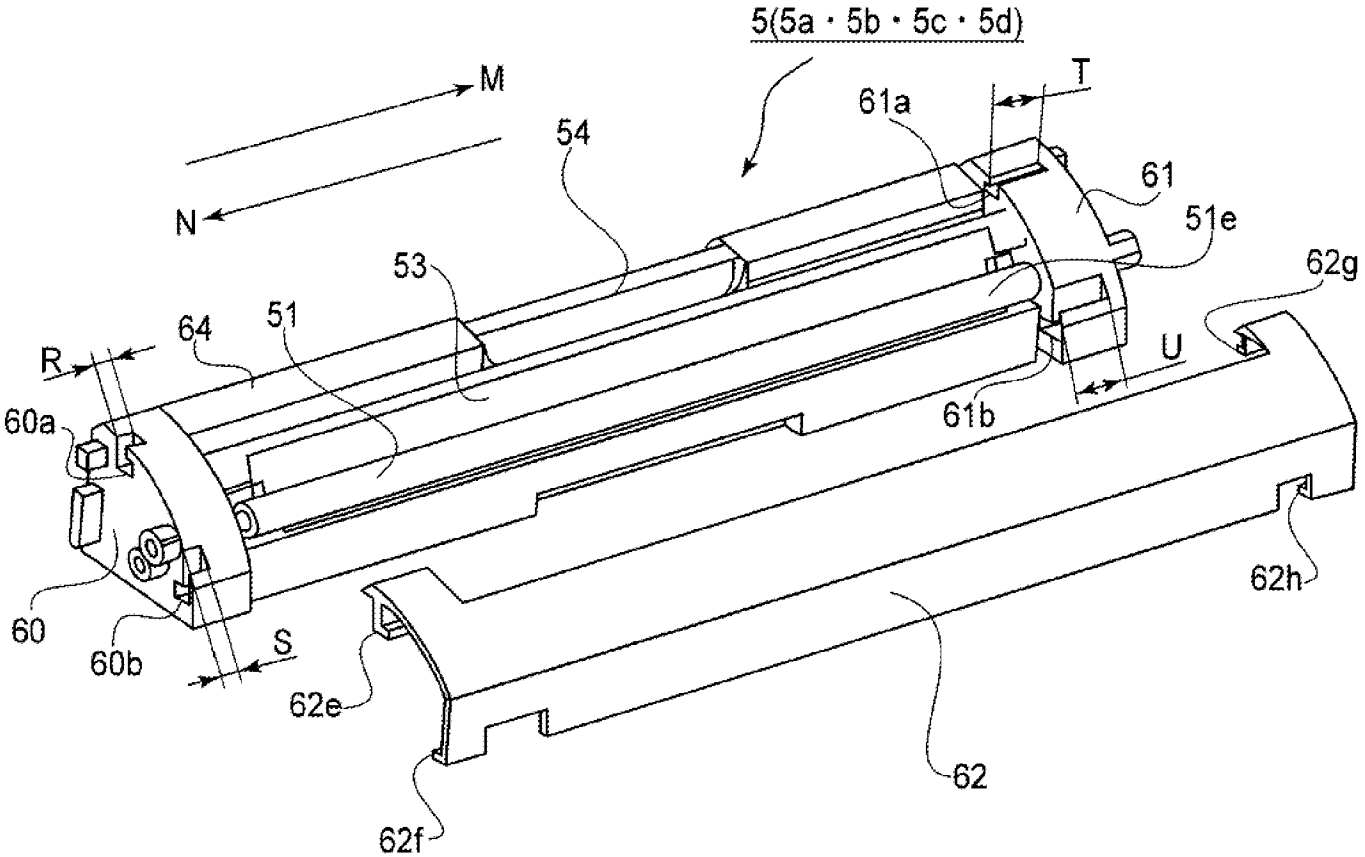

FIG. 28 is a perspective view of the developing cartridge and the covering member in the state that the covering member is removed.

Figure 29:
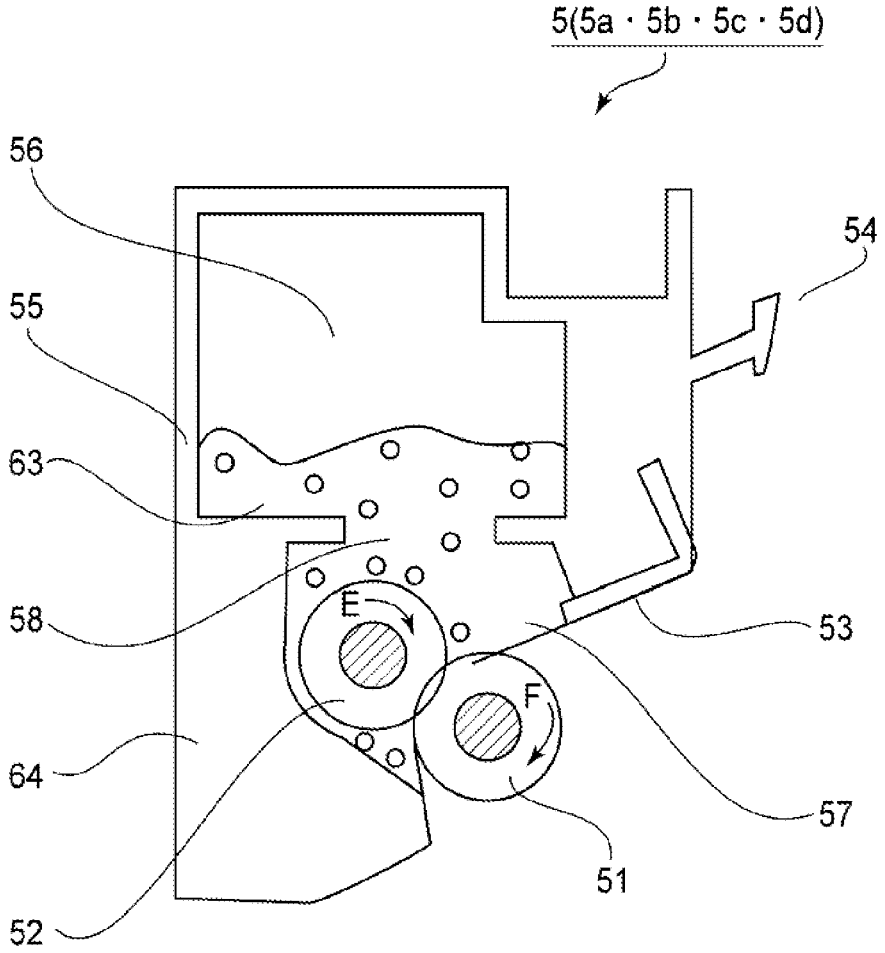

FIG. 29 is an enlarged schematic cross-sectional view of the developing cartridge in the state that the toner seal is removed and the covering member is removed.

Figure 30:
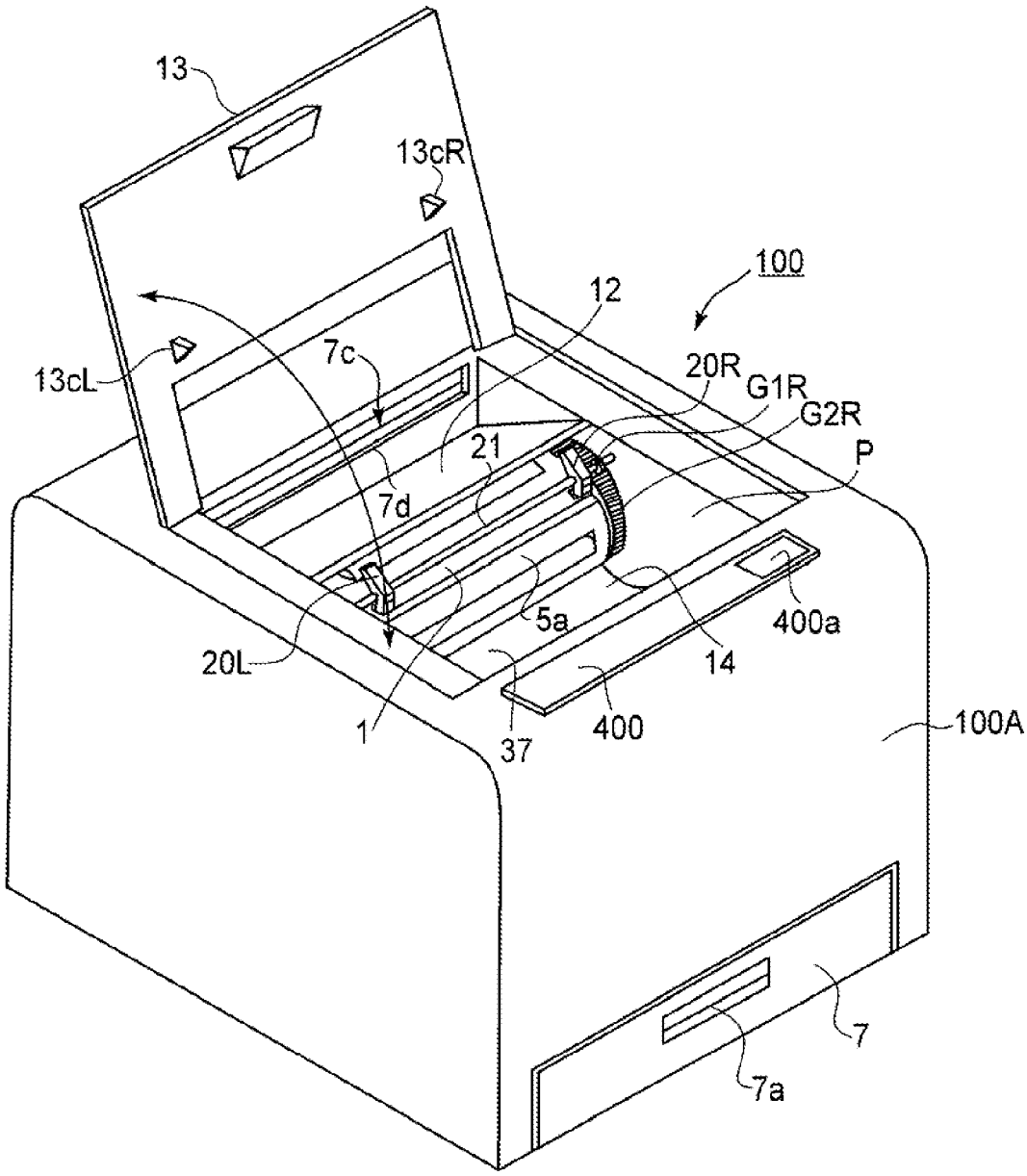

FIG. 30 is a perspective view of an image forming apparatus in the state that a mounting and demounting cover is open.

Figure 31:
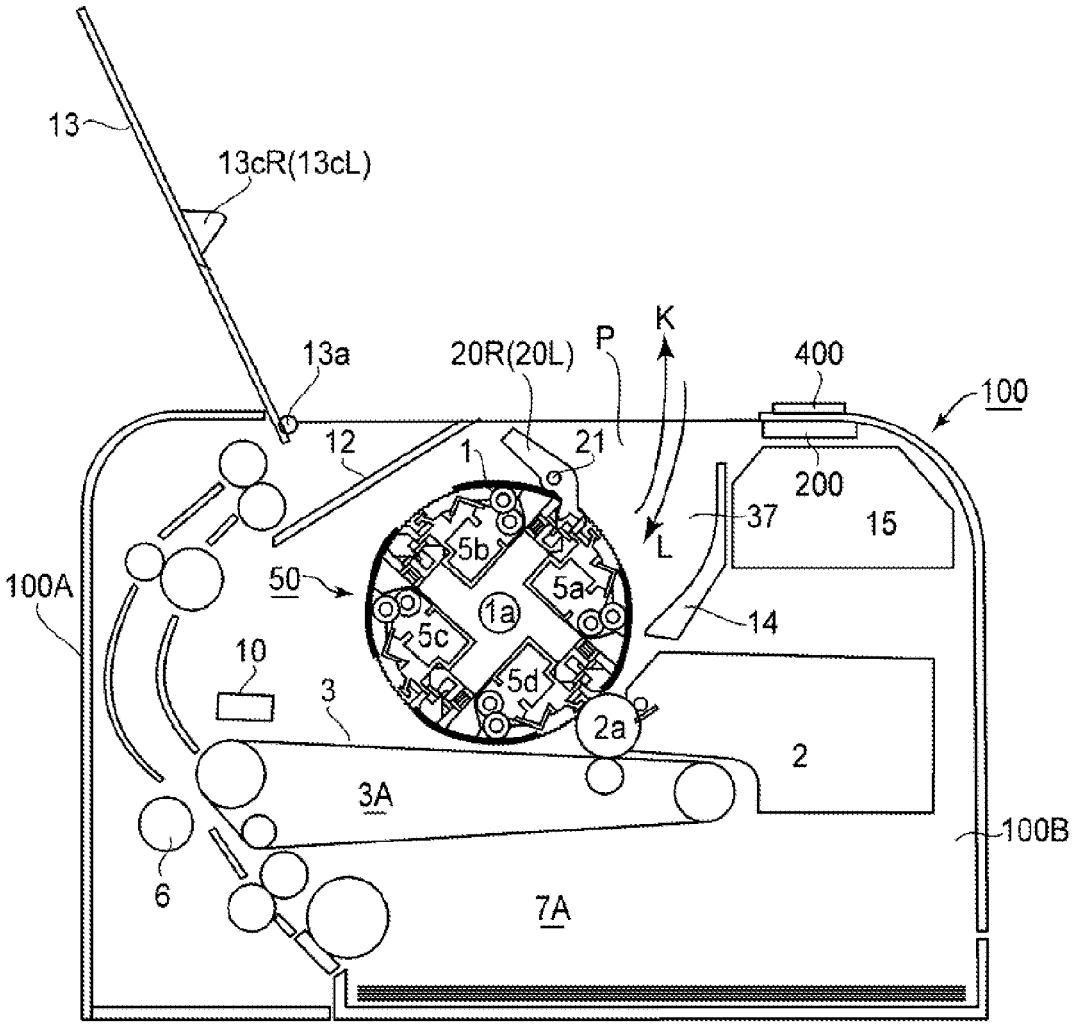

FIG. 31 is a left longitudinal section of the image forming apparatus in the state that the mounting and demounting cover is open.

Figure 32:
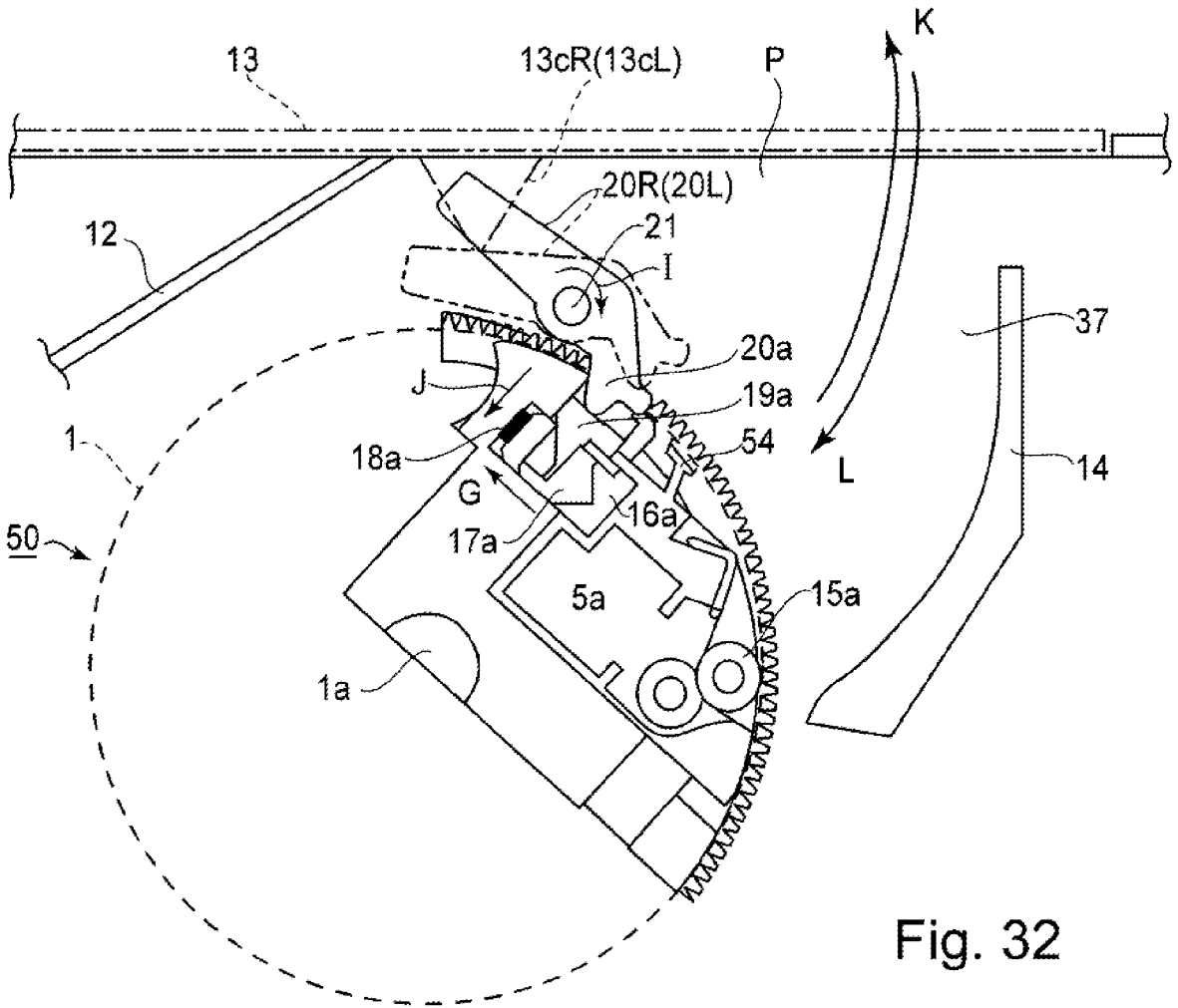

FIG. 32 is a partial enlarged view of FIG. 31.

Figure 33:
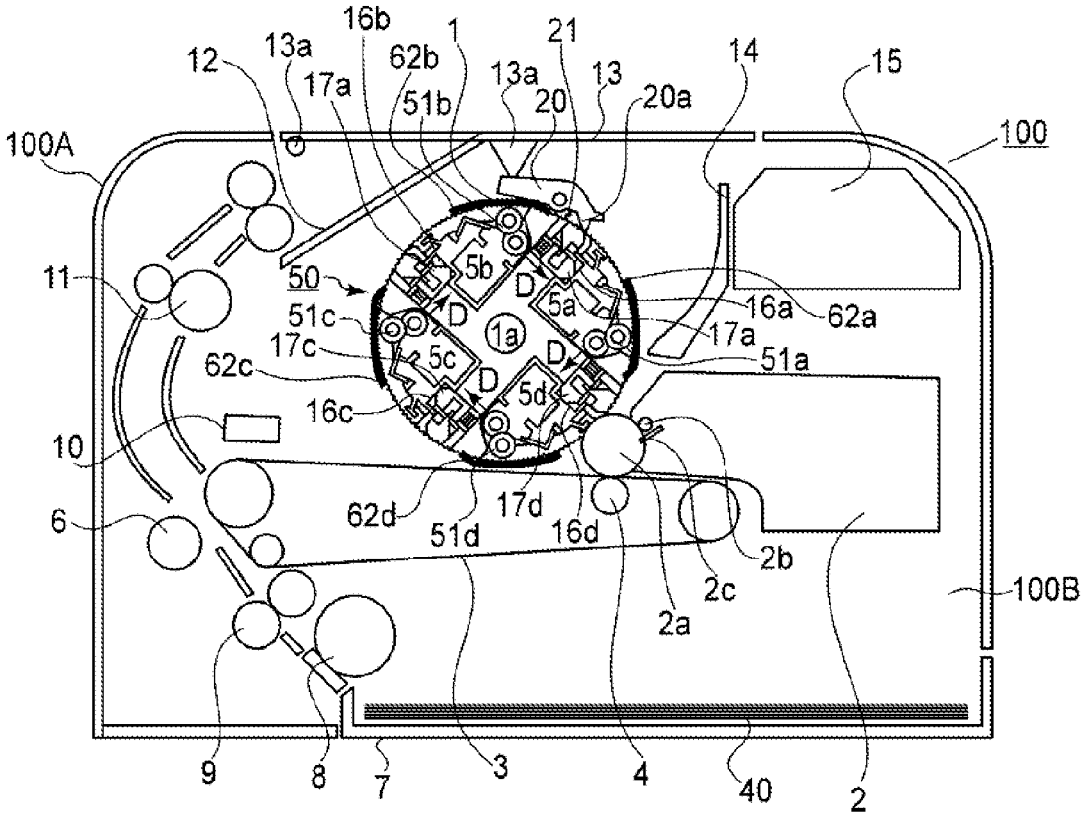

FIG. 33 is a left longitudinal section of the image forming apparatus in the mounted packing state.

Figure 34:
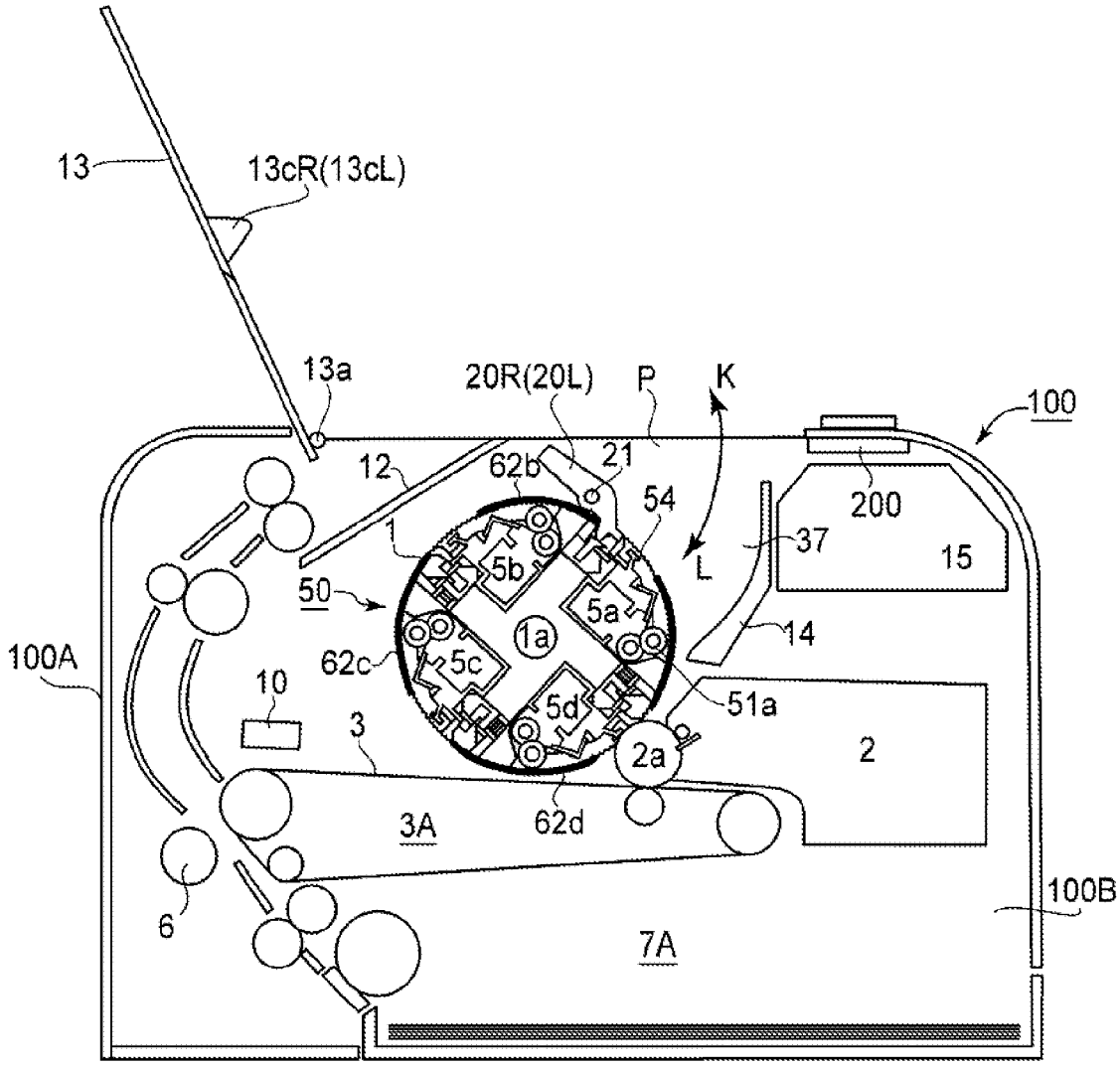

FIG. 34 is a left longitudinal section of the image forming apparatus in the mounted packing state, wherein the mounting and demounting cover is open.

Figure 35:
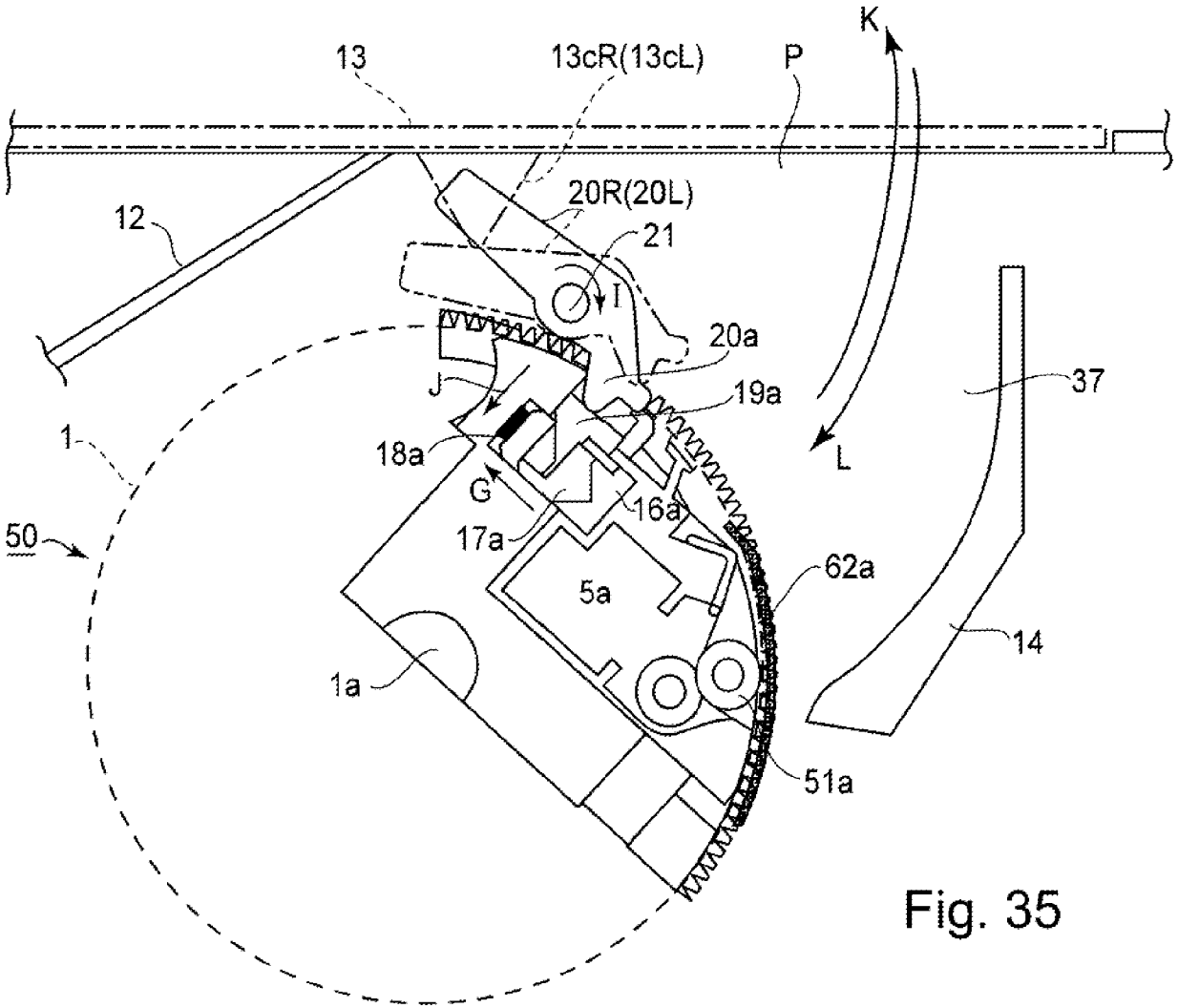

FIG. 35 is a partial enlarged view of FIG. 34.

Figure 36:
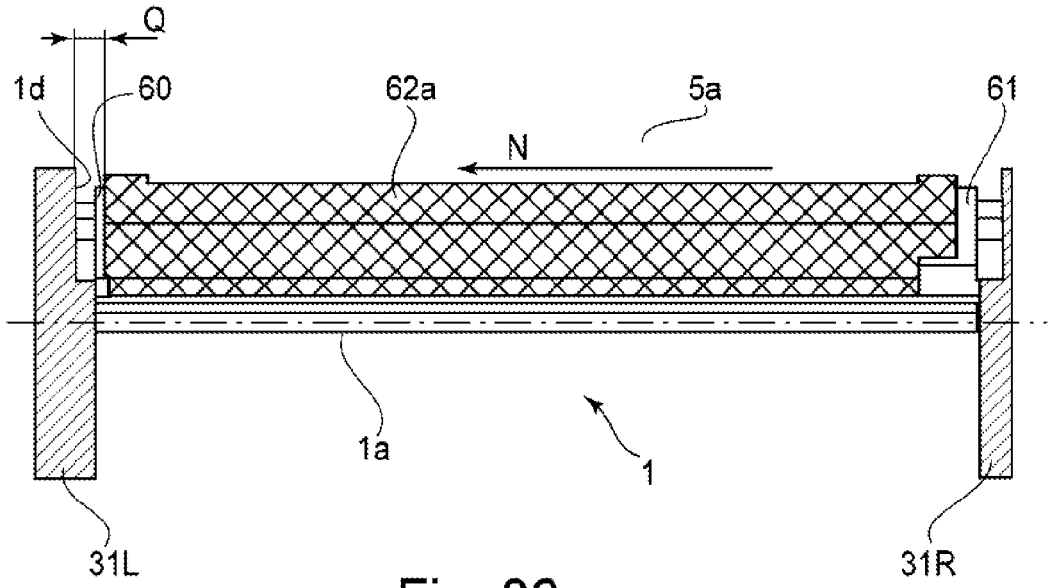

FIG. 36 is a front view of the yellow developing cartridge mounted to the main assembly of the apparatus.

Figure 37:
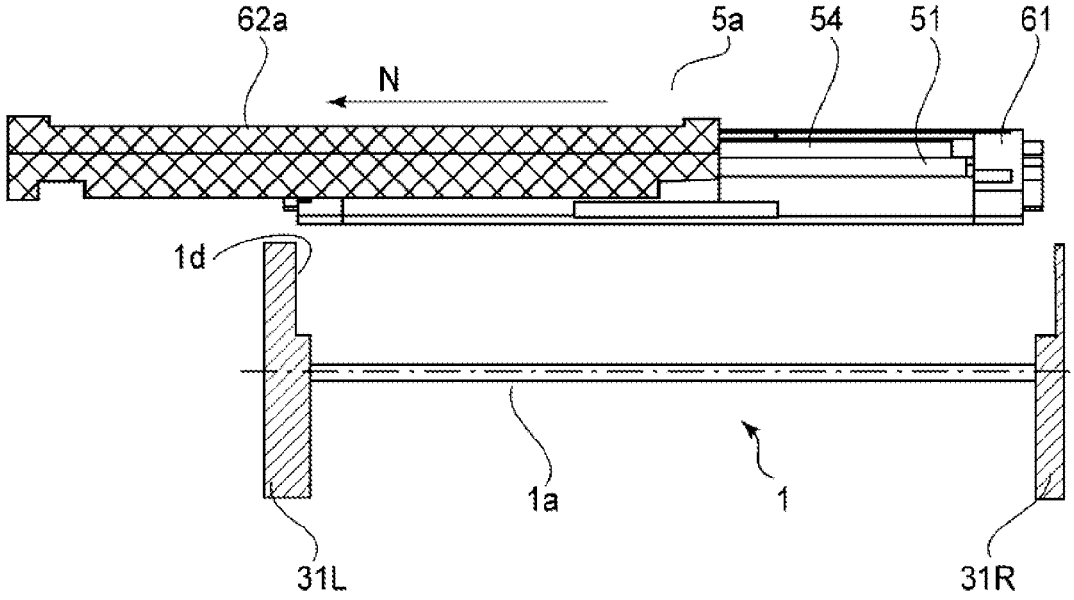

FIG. 37 is an illustration in which the covering member is being moved after the yellow developing cartridge is dismounted from the main assembly of the apparatus, by which the covering member becomes movable.

Figure 38:
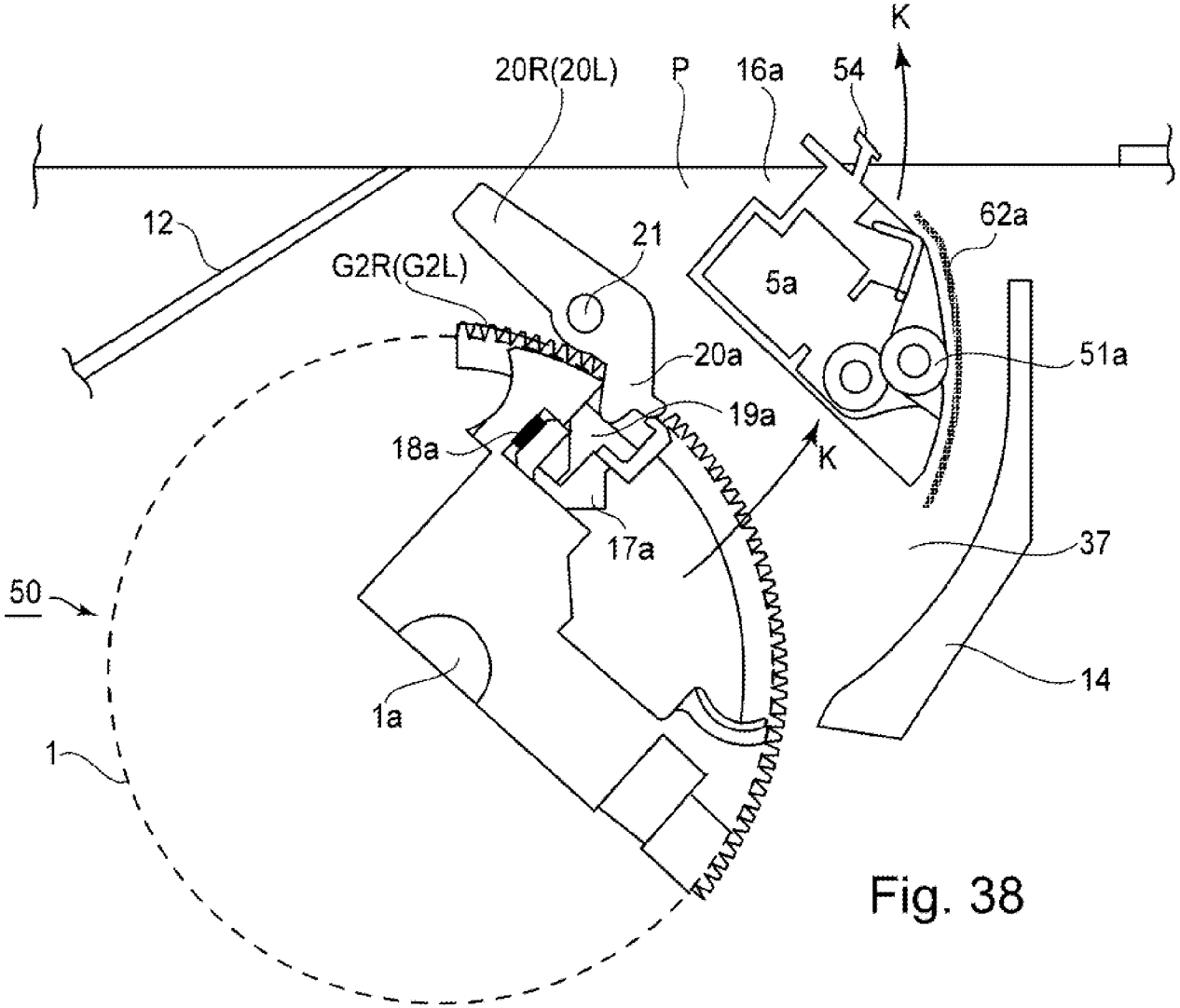

FIG. 38 is an illustration in which the yellow developing cartridge has been dismounted from the state of FIGS. 34 and 35.

Figure 39:
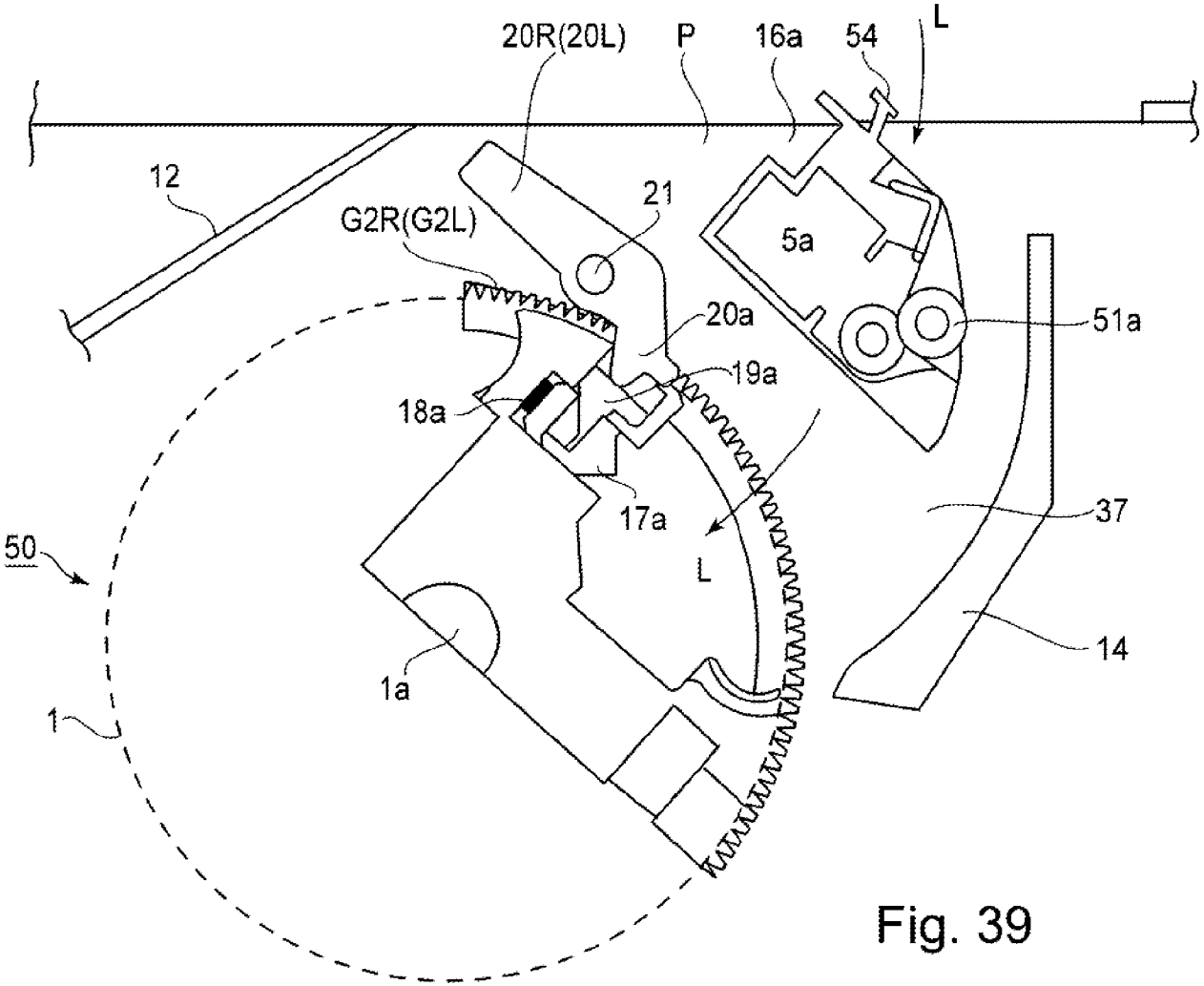

FIG. 39 is an illustration of a state wherein the yellow developing cartridge in which the toner seal is removed, and the covering member is dismounted is being remounted.

INDUSTRIAL APPLICABILITY

According to the present invention, also in the case that the cartridge is downsized, the grip portion is upsized as much as possible so that the usability can be assured.

In addition, according to the present invention, disengagement of the covering member can be prevented at the time of initial installation of the main assembly of the image forming apparatus to which a developing cartridge is detachably mountable in a direction perpendicular to an axial direction of a developer carrying member.

Furthermore, according to the present invention, in a developing cartridge having a grip portion in the direction perpendicular to the developer carrying member, inadvertent disengagement covering member by the grip of the grip portion can be prevented.

The invention claimed is:

1. A developing cartridge detachably mountable to an image forming apparatus, said developing cartridge comprising:

a developer carrying member for developing an electrostatic latent image formed on an image bearing member;

a frame for supporting said developer carrying member;

a protecting member for protecting said developer carrying member, said protecting member being dismountable from said frame in an axial direction of said developer carrying member;

an accommodating portion accommodating a developer to be supplied to said developer carrying member;

a sealing member sealing an opening for permitting the developer to be supplied from said accommodating portion to said developer carrying member; and a grip portion, provided at one longitudinal end of said sealing member, for being gripped when said sealing member is removed from said opening, said grip portion being movable between a first position on a movement locus of said protecting member when said protecting member is dismounted from said frame, and a second position outside the movement locus, wherein said grip portion is moved from the first position to the second position by contacting to said protecting member when said protecting member is dismounted from said frame.

2. A developing cartridge according to claim 1, wherein said grip portion is locked to said frame in the first position.

3. A developing cartridge detachably mountable to an image forming apparatus, said developing cartridge comprising:

a developer carrying member for developing an electrostatic latent image formed on an image bearing member;

a frame for supporting said developer carrying member;

a protecting member for protecting said developer carrying member, said protecting member being dismountable from said frame in an axial direction of said developer carrying member;

an accommodating portion accommodating a developer to be supplied to said developer carrying member;

a sealing member sealing an opening for permitting the developer to be supplied from said accommodating portion to said developer carrying member; and a grip portion, provided at one longitudinal end of said sealing member, for being gripped when said sealing member is removed from said opening, said grip portion being movable between a first position on a movement locus of said protecting member when said protecting member is dismounted from said frame, and a second position outside the movement locus, wherein said grip portion takes an attitude crossing with an axis of said developer carrying member in the first position, and takes an attitude substantially parallel with the axis of said developer carry member in the second position.

4. A process cartridge detachably mountable to an image forming apparatus, said process cartridge comprising:

an image bearing member on which an electrostatic latent image is to be formed;

a frame supporting said image bearing member;

a protecting member for protecting said image bearing member, said protecting member being dismountable from said frame in an axial direction of said image bearing member;

a developer carrying member for developing an electrostatic latent image formed on said image bearing member;

an accommodating portion accommodating a developer to be supplied to said developer carrying member;

a sealing member sealing an opening for permitting the developer to be supplied from said accommodating portion to said developer carrying member; and a grip portion, provided at one longitudinal end of said sealing member, for being gripped when said sealing member is removed from said opening, said grip portion being movable between a first position on a movement locus of said protecting member when said protecting member is dismounted from said frame, and a second position outside the movement locus.

5. A process cartridge according to claim 4, wherein said grip portion is locked to said frame in the first position.

6. A process cartridge according to claim 4, wherein said grip portion takes an attitude crossing with an axis of said developer carrying member in the first position, and takes an attitude substantially parallel with the axis of said developer carrying member in the second position.

7. An image forming apparatus for forming an image on a recording material, said image forming apparatus comprising:

(i) a mounting portion;

(ii) an image bearing member;

(iii) a developing cartridge mounted to said mounting portion, said developing cartridge including:

a developer carrying member for developing an electrostatic latent image formed on said image bearing member, a frame for supporting said developer carrying member, a protecting member for protecting said developer carrying member, said protecting member being dismountable from said frame in an axial direction of said developer carrying member, an accommodating portion accommodating a developer to be supplied to said developer carrying member, a sealing member sealing an opening for permitting the developer to be supplied from said accommodating portion to said developer carrying member, and a grip portion, provided at one longitudinal end of said sealing member, for being gripped when said sealing member is removed from said opening, wherein said developing cartridge is dismountable from said mounting portion in a direction perpendicular to the axial direction of said developer carrying member;

(iv) a regulating portion, contacted to said protecting member in a state that said developing cartridge is mounted to said mounting portion, for preventing movement of said protecting member in the axial direction of said developer carrying member; and (v) feeding means for feeding the recording material.

8. An apparatus according to claim 7, wherein said grip portion is movable between a first position on a movement locus of said protecting member when said protecting member is dismounted from said frame, and a second position outside the movement locus.

9. An apparatus according to claim 7, wherein said mounting portion is a rotatable member that is rotatably supported by a main assembly of the apparatus, said rotatable member dismountably carrying a plurality of developing cartridges, with said developing cartridge being one of said plurality of cartridges, and wherein said rotatable member is provided with said regulating portion.

10. An apparatus according to claim 7, wherein said developing cartridge includes a second grip portion provided on said frame to be gripped when said developing cartridge is mounted to and dismounted from a main assembly of the apparatus in the perpendicular direction.

* * * * *